US012225950B2

(12) United States Patent
Liu

(10) Patent No.: US 12,225,950 B2
(45) Date of Patent: Feb. 18, 2025

(54) METHOD OF MANUFACTURING AN ARTICLE OF CLOTHING

(71) Applicant: Regina Miracle International (Group) Limited, Hong Kong (CN)

(72) Inventor: Zhenqiang Liu, Hong Kong (CN)

(73) Assignee: Regina Miracle International (Group) Limited, Hong Kong (CN)

( * ) Notice: Subject to any disclaimer, the term of this patent is extended or adjusted under 35 U.S.C. 154(b) by 566 days.

(21) Appl. No.: 17/615,813

(22) PCT Filed: Jun. 5, 2019

(86) PCT No.: PCT/CN2019/090159
§ 371 (c)(1),
(2) Date: Dec. 1, 2021

(87) PCT Pub. No.: WO2020/243924
PCT Pub. Date: Dec. 10, 2020

(65) Prior Publication Data

US 2022/0304397 A1 Sep. 29, 2022

(51) Int. Cl.
*A41C 5/00* (2006.01)
*A41H 43/04* (2006.01)

(52) U.S. Cl.
CPC ..... *A41C 5/00* (2013.01); *A41H 43/04* (2013.01)

(58) Field of Classification Search
CPC ..... A41H 43/04; A41C 5/00
USPC ..... 450/39
See application file for complete search history.

(56) References Cited

U.S. PATENT DOCUMENTS 5,447,462 A * 9/1995 Smith ..... A41C 5/00 450/156
5,916,829 A * 6/1999 Girard ..... A41D 31/02 450/156
6,645,040 B2 * 11/2003 Rabinowicz ..... A41C 5/00 450/1

(Continued)

FOREIGN PATENT DOCUMENTS

CN 102548752 A 7/2012
CN 104544594 A 4/2015

(Continued)

OTHER PUBLICATIONS

Authorized Officer: Wang, Wei, International Search Report and Written Opinion issued in counterpart PCT application No. PCT/CN2019/090159, Mar. 6, 2020, 9 pp.

(Continued)

*Primary Examiner* — Gloria M Hale
(74) *Attorney, Agent, or Firm* — Kaplan Breyer Schwarz, LLP

(57) ABSTRACT

A method of manufacturing an article of clothing is disclosed. The method includes applying an adhesive to a release paper and trimming the release paper having the adhesive to a desired shape and size. The method further includes providing a first layer of material and a second layer of material, and transferring the adhesive from the release paper to the first layer of material. Furthermore, the method includes adhesively bonding the first layer of material to the second layer of material, and curing the adhesive disposed between the first layer of material and the second layer of material.

20 Claims, 21 Drawing Sheets

(56) References Cited

U.S. PATENT DOCUMENTS

| | | | | |
|---|---|---|---|---|
| 6,837,771 | B2 * | 1/2005 | Falla | A41C 3/0014 2/400 |
| 7,690,965 | B2 * | 4/2010 | Falla | A41C 3/0014 450/39 |
| 8,113,908 | B1 * | 2/2012 | Modena | A41C 3/0014 450/39 |
| 2004/0242120 | A1 | 12/2004 | Warren et al. | |

FOREIGN PATENT DOCUMENTS

| | | | |
|---|---|---|---|
| CN | 106263047 | A | 1/2017 |
| CN | 106820294 | A | 6/2017 |
| CN | 106903964 | A | 6/2017 |
| CN | 106923386 | A | 7/2017 |
| CN | 109434952 | A | 3/2019 |
| TW | 200412226 | A | 7/2004 |
| WO | 92/00187 | A1 | 1/1992 |
| WO | 2018/218099 | A1 | 11/2018 |

OTHER PUBLICATIONS

Office Action issued in Chinese patent application No. 2019800431713, Mar. 15, 2022, 24 pp. w/ translation.
Office Action issued in Chinese patent application No. 2019800431713, Aug. 16, 2022, 25 pp. w/ translation.
Office Action issued in Chinese Patent Application No. 201980043171.3, Jan. 5, 2023, 20 pp. w/ machine translation.

* cited by examiner

METHOD OF MANUFACTURING AN ARTICLE OF CLOTHING

FIELD OF THE PRESENT DISCLOSURE

The present disclosure relates generally to a method of manufacturing an article of clothing, and in particular, to a method of adhesively attaching two layers of material by applying adhesive to one of the layers using a roller mechanism.

BACKGROUND

An article of clothing generally includes more than one panel of material attached to each other. Conventionally, the panels are attached by sewing the panels together with thread. Also, recently, garment manufacturers have started attaching panels of material together by welding overlapping edges using heat and pressure. When heat is applied, the overlapping portions of the fabric melt and fuse together forming a seam. This method works well with thermoplastic materials, but less well with woven fabrics. Fabrics are composed of small fibrous materials and when they are heated the fibers become brittle. As a result, the strength and flexibility of the small fibers is compromised.

Additionally, some manufactures have started to join panels using adhesive. For so doing, a strip of adhesive or glue tape may be positioned between overlapping panels, and pressure and heat are applied to melt the tape, and thereby adhesively joining the overlapping panels.

SUMMARY

In one aspect, a method of manufacturing an article of clothing is disclosed. The method includes applying an adhesive to a release paper and trimming the release paper having the adhesive to a desired shape and size. The method further includes providing a first layer of material and a second layer of material, and transferring the adhesive from the release paper to the first layer of material. Furthermore, the method includes adhesively bonding the first layer of material to the second layer of material, and curing the adhesive disposed between the first layer of material and the second layer of material.

In one or more embodiments, the adhesive is applied on the release paper by feeding the release paper through a roller mechanism having a roller with the adhesive disposed on a surface of the roller.

In one or more embodiments, providing the first layer of material includes trimming first layer of material into a desired shape and size.

In one or more embodiments, transferring the adhesive from the release paper to the first layer of material includes positioning the first layer of material on the release paper such that adhesive is sandwiched between the release paper and the first layer of material, and hot pressing the first layer of material and the release paper to facilitate a transfer of adhesive to the first layer of material.

In one or more embodiments, adhesively bonding the first layer of material and the second layer of material includes positioning the second layer of material on the first layer of material such that adhesive is sandwiched between the first layer of material and the second layer of material, and hot pressing the first layer of material and the second layer of material to facilitate the adhesive boding of first layer of material and the second layer of material.

In one or more embodiments, the first layer of material is an inner layer of the article of clothing and the second layer of material is an outer layer of the article of clothing.

In another aspect, a method of manufacturing at least a portion of an article of clothing is disclosed. The method includes applying an adhesive to a first layer of material and trimming the first layer of material having the adhesive to a desired shape and size. The method also includes providing a second layer of material, and adhesively bonding, by hot pressing, the first layer of material to the second layer of material. The method further includes curing the adhesive disposed between the first layer of material and the second layer of material.

In one or more embodiments, the adhesive is applied on the first layer of material by feeding the first layer of material through a roller mechanism having a roller with the adhesive disposed on a surface of the roller.

In one or more embodiments, providing the second layer of material includes trimming second layer of material into a desired shape and size.

In one or more embodiments, adhesively bonding the first layer of material and the second layer of material includes positioning the second layer of material on the first layer of material such that adhesive is sandwiched between the first layer of material and the second layer of material, and hot pressing the first layer of material and the second layer of material to facilitate the adhesive boding of first layer of material and the second layer of material.

In one or more embodiments, wherein the first layer of material is an inner layer of the article of clothing and the second layer of material is an outer layer of the article of clothing.

In yet another aspect, a method of manufacturing a brassiere is disclosed. The method includes applying an adhesive to a release paper and trimming the release paper having the adhesive to a desired shape and size. The method further includes providing a first layer of material defining an inner layer of the brassiere and a second layer of material defining an outer layer of the brassiere, and transferring the adhesive from the release paper to inner layer. The method also includes adhesively bonding the inner layer to the outer layer to form a bra panel of the brassiere, and curing the adhesive disposed between the inner layer and the outer layer.

In one or more embodiments, the adhesive is applied on the first layer of material by feeding the first layer of material through a roller mechanism having a roller with the adhesive disposed on a surface of the roller.

In one or more embodiments, providing the first layer of material includes trimming the first layer of material to define the outer layer of brassiere. The outer layer includes a first portion, a second portion, an elongated opening disposed between the first portion and the second portion, and a pair of strap portion connecting the first portion to the second portion.

In one or more embodiments, a lateral width of the first portion of the outer layer is greater than a lateral width of the first portion of the inner layer.

In one or more embodiments, a lateral width of the second portion of the outer layer is greater than a lateral width of the second portion of the inner layer In one or more embodiments, the first portions of the inner layer and the outer layer define a front portion of the brassiere, and the second portions of the inner layer and the outer layer defines a back portion of the brassiere.

In one or more embodiments, transferring the adhesive from the release paper to the inner layer includes positioning the inner layer on the release paper such that adhesive is sandwiched between the release paper and the inner layer, and hot pressing the inner layer and the release paper to facilitate a transfer of adhesive to inner layer.

In one or more embodiments, adhesively bonding the inner layer and the outer layer includes positioning the outer layer on the inner layer such that adhesive is sandwiched between the inner layer and outer layer, and hot pressing the inner layer and the outer layer to facilitate the adhesive boding of inner layer and the outer layer.

In one or more embodiments, the bra panel includes a pair of bra cup portions formed by the inner layer disposed abutting the outer layer. The method further includes positioning the bra panel inside on a first mould having a pair of bra cup openings. The bra panel is positioned on the first mould such that the pair of bra cup portions are disposed above the pair of bra cup openings. The method also includes hot pressing a second mould on the bra panel to form a pair of bra cups of the brassiere. The second mould includes a pair of protrusions corresponding to the pair of bra cup openings for pushing the pair of bra cup portions into the pair of bra cup openings to form the pair of bra cups.

The foregoing summary is illustrative only and is not intended to be in any way limiting. In addition to the illustrative aspects, embodiments, and features described above, further aspects, embodiments, and features will become apparent by reference to the drawings and the following detailed description.

BRIEF DESCRIPTION OF THE DRAWINGS

For a more complete understanding of example embodiments of the present disclosure, reference is now made to the following descriptions taken in connection with the accompanying drawings in which.

DETAILED DESCRIPTION

Figure 1B:
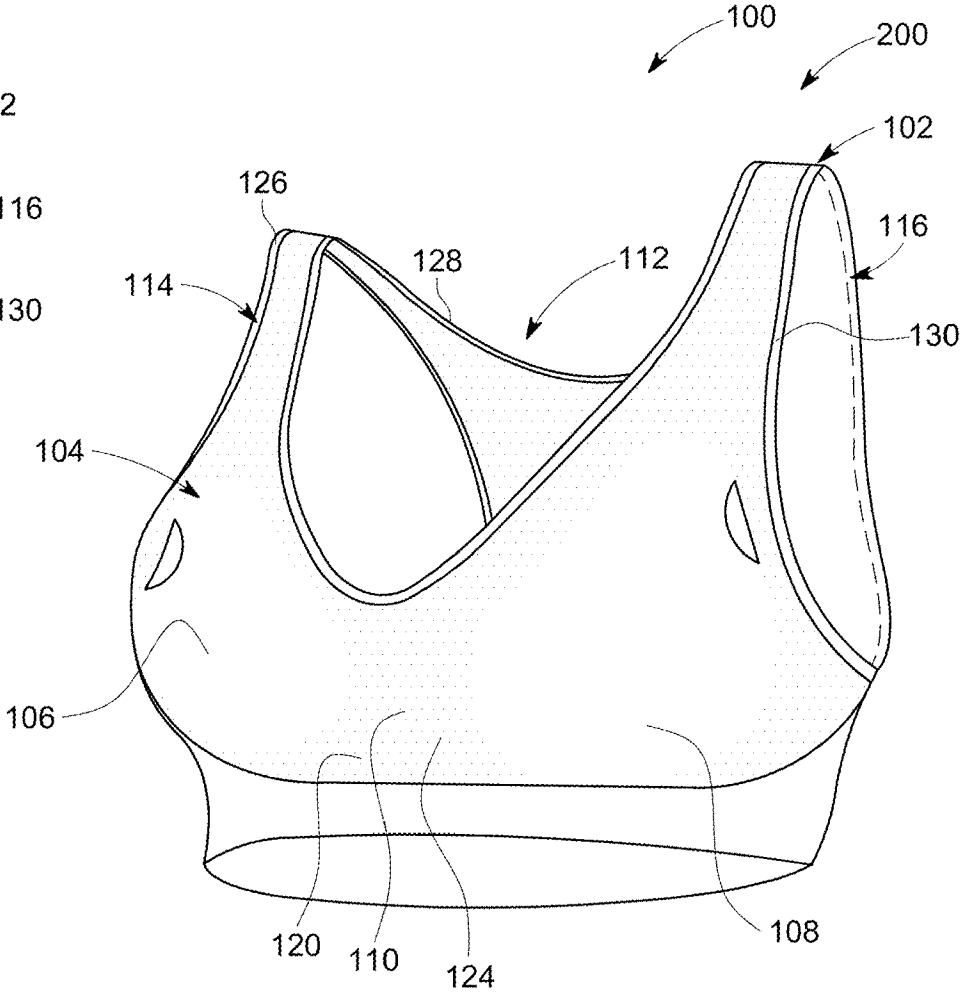
FIG. 1B illustrates a front perspective view of the brassiere of the FIG. 1A that is folded inside out, in accordance with one or more embodiments of the present disclosure.
Figure 1A:
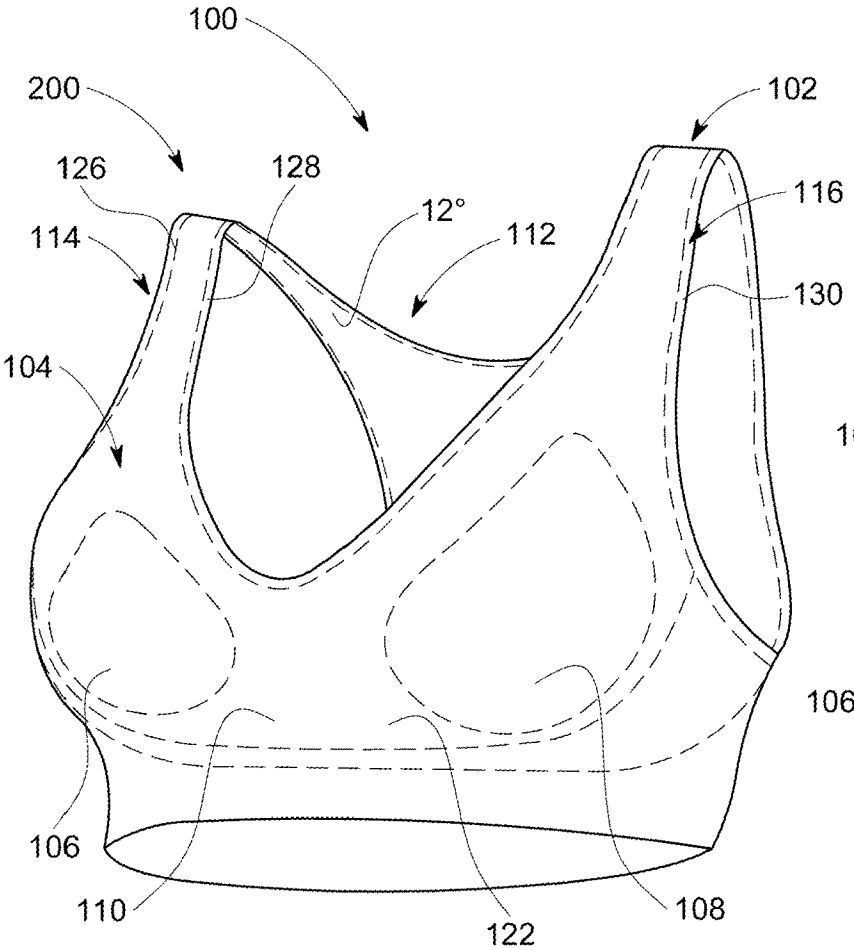
FIG. 1A illustrates a front perspective view of a brassiere, in accordance with one or more embodiments of the present disclosure.

In the following description, for purposes of explanation, numerous specific details are set forth in order to provide a thorough understanding of the present disclosure. It will be apparent, however, to one skilled in the art that the present disclosure can be practiced without these specific details. In other instances, apparatuses and methods are shown in block diagram form only in order to avoid obscuring the present disclosure.

Reference in this specification to "one embodiment" or "an embodiment" means that a particular feature, structure, or characteristic described in connection with the embodiment is included in at least one embodiment of the present disclosure. The appearance of the phrase "in one embodiment" in various places in the specification are not necessarily all referring to the same embodiment, nor are separate or alternative embodiments mutually exclusive of other embodiments. Further, the terms "a" and "an" herein do not denote a limitation of quantity, but rather denote the presence of at least one of the referenced item. Moreover, various features are described which may be exhibited by some embodiments and not by others. Similarly, various requirements are described which may be requirements for some embodiments but not for other embodiments.

The embodiments are described herein for illustrative purposes and are subject to many variations. It is understood that various omissions and substitutions of equivalents are contemplated as circumstances may suggest or render expedient, but are intended to cover the application or implementation without departing from the spirit or the scope of the present disclosure. Further, it is to be understood that the phraseology and terminology employed herein are for the purpose of the description and should not be regarded as limiting. Any heading utilized within this description is for convenience only and has no legal or limiting effect.

Where there is reference to the word "layer" it is to be understood that it may have its common definition and, but not limited to that the layer could consist of one panel or may have regions that are defined by two or more panels that are joined and that may each be of a different characteristic (e.g. color, thickness, material, orientation, size).

Referring to the FIGS. 1A, 1B, 2A, and 2B, an article of clothing 100 is shown, in accordance with one or more embodiments of the present disclosure. The article of clothing 100 may be any garment to be worn by a wearer. For example, the article of clothing 100 may be, but not limited to, a brassiere, a bra top, a sports top, a pantie, a T-shirt, a pant, and the like. In the exemplary illustration of FIG. 1, the article of clothing 100 is shown to be a brassiere 200. The brassiere 200 includes a body structure 102 which defines a shape of the brassiere 200. The body structure 102 includes a front portion 104 having a pair of bra cups, for example, a first bra cup 106 and a second bra cup 108, and a center gore 110 disposed between the first bra cup 106 and the second bra cup 108 and connecting the first bra cup 106 and the second bra cup 108. The brassier 200 further includes a back portion 112 and a pair of straps, including a first strap 114 and a second strap 116, extending from peripheries of the first bra cup 106 and the second bra cup 108, respectively to the back portion 112. It may be contemplated that the pair of straps 114, 116 support the brassiere 200 on shoulders of the wearer.

Figure 2B:
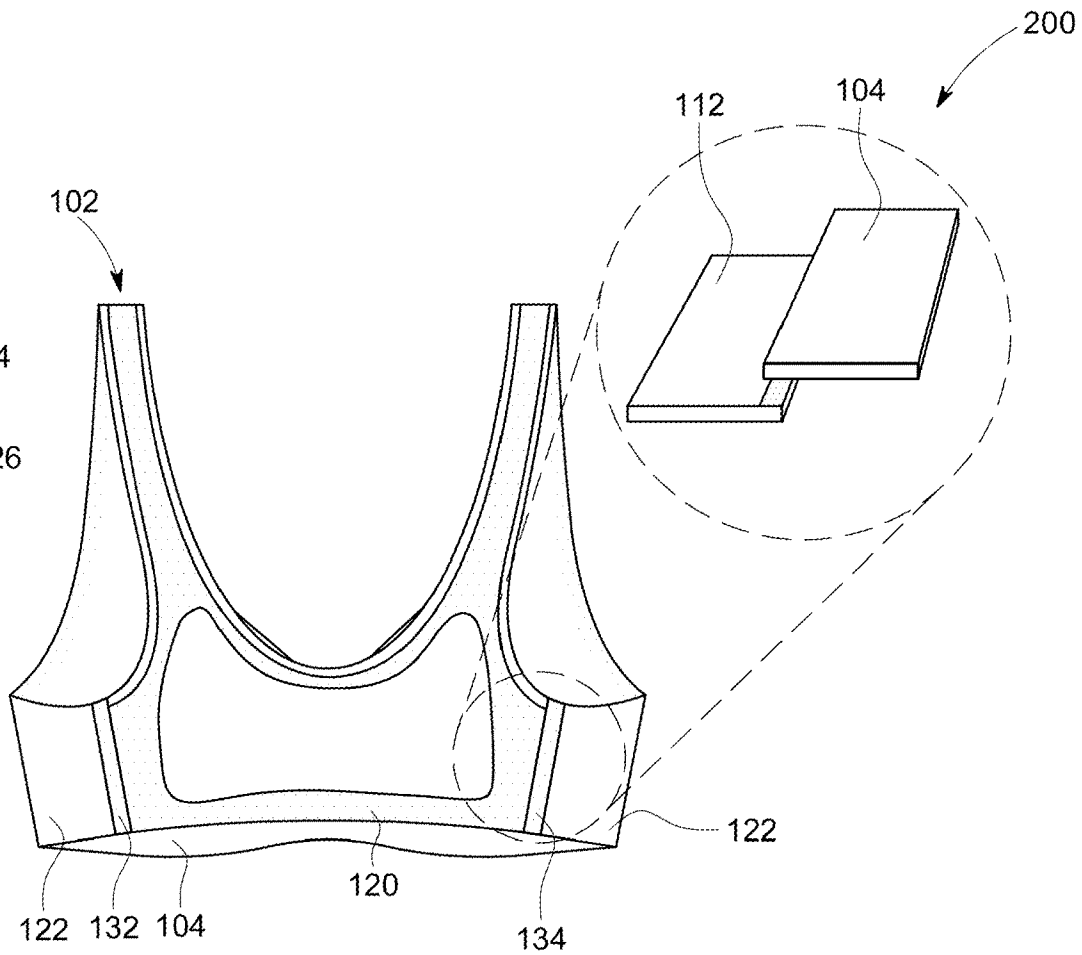
FIG. 2B illustrates a front view of a back portion of the brassiere of FIG. 1B, in accordance with one or more embodiments of the present disclosure.
Figure 2A:
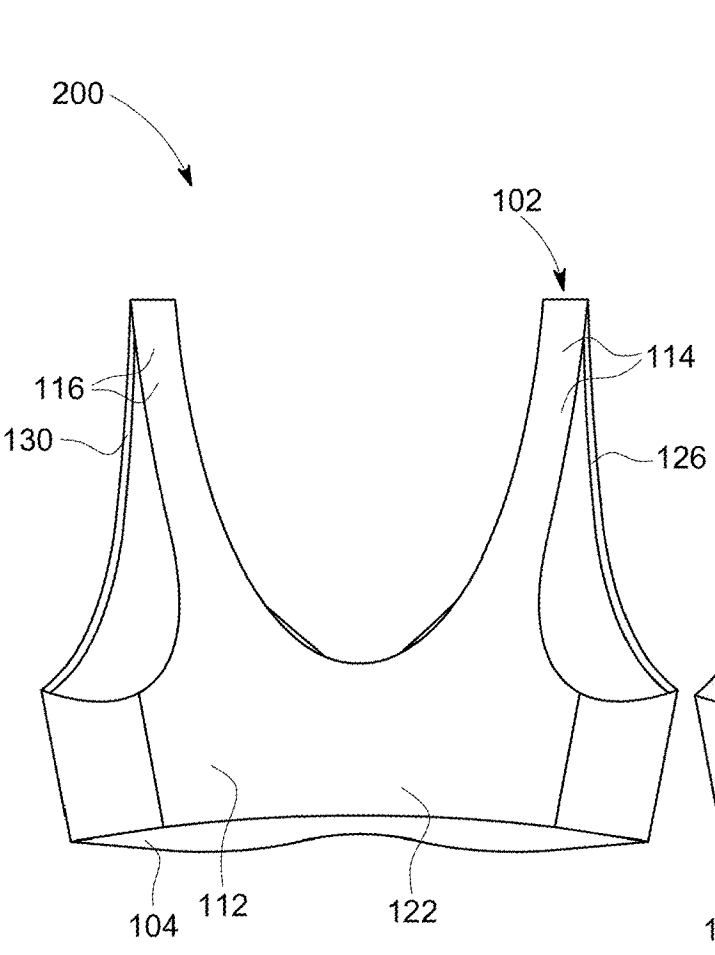
FIG. 2A illustrates a front view of a back portion of the brassiere of FIG. 1A, in accordance with one or more embodiments of the present disclosure.

In the present embodiments, the brassiere 200 includes a first layer of material 120 (also referred to as an inner layer 120) and a second layer of material 122 (also referred to as an outer layer 122) attached to the first layer of material 120. As shown, the first layer of material 120 is adhesively attached to the second layer of material 122. In an embodiment, the inner layer 120 is attached to the outer layer 122 by a plurality of adhesive dots 124 (shown in FIG. 1B) that are disposed/sandwiched between the inner layer 120 and the outer layer 122. In an implementation, as illustrated in FIGS. 1B and 2B, a size of the outer layer 120 is larger than the inner layer 120 such that edge portions 126, 128, 130 of the brassier 200 include only the outer layer 122 and are devoid of the inner layer 120, and therefore facilitate a smooth transition to a body of the wearer. In another implementation, a size and a shape of the inner layer 120 may match with a shape and a size of the outer layer 122. Further, the bra cups 106, 108 include the inner layer 120 and the outer layer 122 disposed abutting each other, and is devoid of any adhesive therebetween. Further, as shown in FIG. 2B, the brassier 200 includes a first overlapped portion 132 and a second overlapped portion 134 having the front portion 102 overlapping and attached to the back portion 112. In an embodiment, the front portion 104 and the back portion 112 may be adhesively attached to each other.

Figure 3:
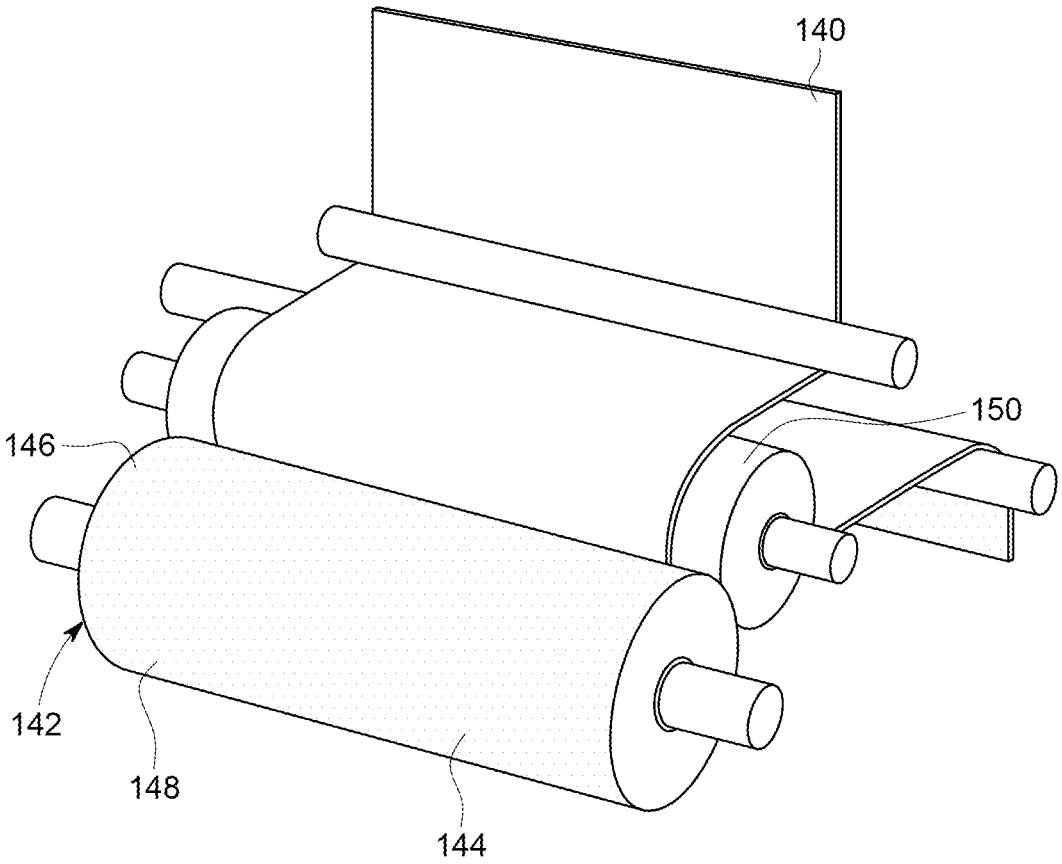
FIG. 3 illustrates a step of a method of manufacturing the brassiere in which adhesive is applied on a release paper, in accordance with one or more embodiments of the present disclosure.

Referring to FIGS. 3 to 9B, various steps of a method of forming the article of clothing 100 as brassier 200 is explained. FIG. 3 discloses a step of method in which an adhesive is applied to a release paper 140 using a roller mechanism 142. The roller mechanism 142 may include a first roller 144 having the adhesive 146 disposed on an outer surface 148 of the first roller 144, and a second roller 150 disposed proximate to the first roller 144, and adapted to feed the release paper 140 to a space between the first roller 144 and the second roller 150. As the release paper 140 passes through the space between the two rollers 144, 150, the release paper 140 contacts the outer surface 148 of the first roller 144. In so doing, the adhesive (shown as dots) is transferred to the release paper 140. In an implementation, the adhesive is applied as a plurality of dots on the release paper 140. For so doing, the first roller 144 may include a plurality of grooves (not shown) arranged on the outer surface 140 of the first roller 144. The adhesive is deposited into the grooves, which gets transferred to the release paper 140 as the plurality of dots as the first roller 144 is heated and pressed against the release paper 140.

Figure 4:
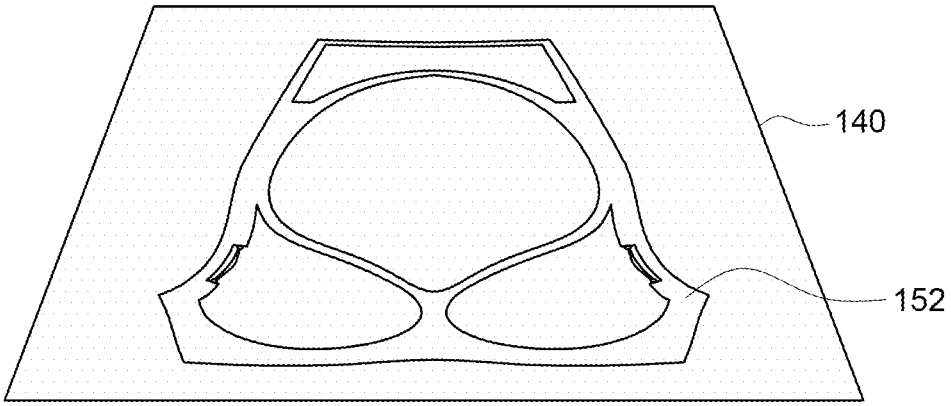
FIG. 4 illustrates a step of the method of manufacturing the brassiere in which release paper is cut into a desired size and shape, in accordance with one or more embodiments of the present disclosure.
Figure 5:
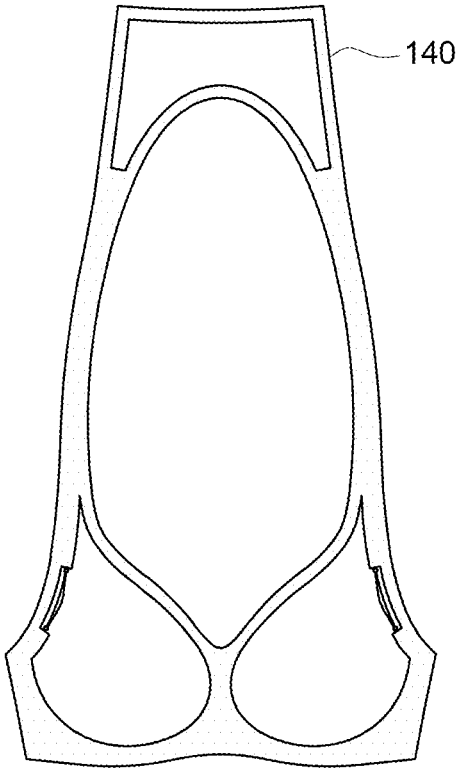
FIG. 5 illustrates a top view of the release paper having the desired shape and size, in accordance with one or more embodiments of the present disclosure.
Figure 6A:
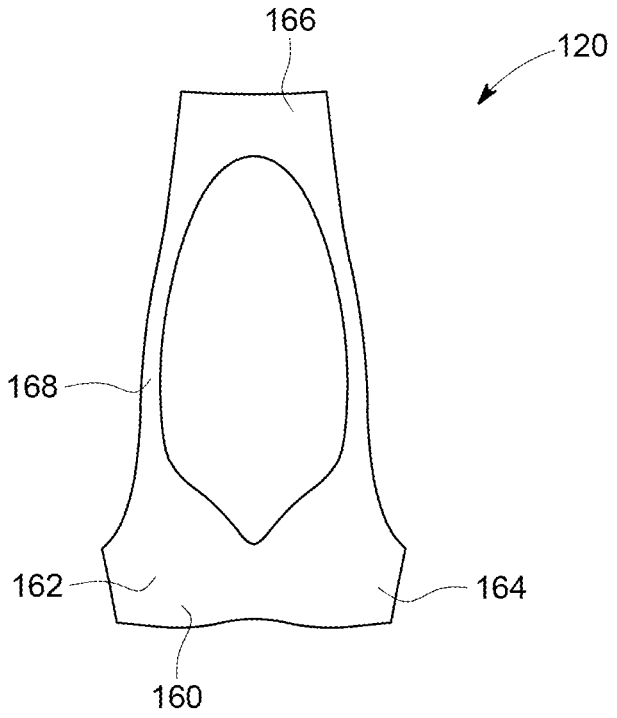
FIG. 6A illustrates a step of the method of manufacturing of the brassiere in which an inner layer of the brassiere is provided, in accordance with one or more embodiments of the present disclosure.
Figure 6B:
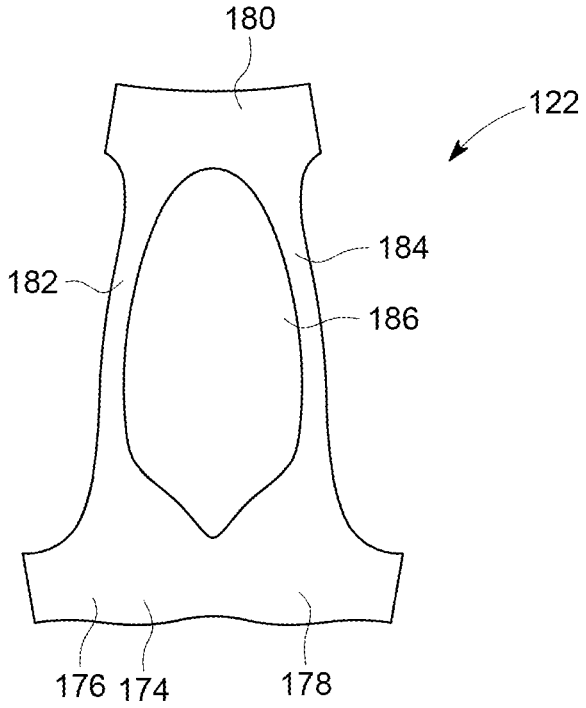
FIG. 6B illustrates a step of the method of manufacturing of the brassiere in which an outer layer of the brassiere is provided, in accordance with one or more embodiments of the present disclosure.

Thereafter, as shown in FIG. 4, the method includes trimming or cutting the release paper 140 coated with adhesive into a desired shape. For so doing, a stencil 152 may be positioned on the release paper 140, and the release paper 140 is cut/trimmed into the desired shape following contours of the stencil 152. In the example shown in FIG. 5, the desired shape of release paper corresponds to a shape of the inner layer 120 of the brassier 200. Further, the method includes, as shown in FIGS. 6A and 6B, providing the first layer of material 120 (inner layer 120 of the brassier 200) and the second layer of material 122 (outer layer 122 of the brassiere 200) that includes cutting or trimming a blank of first layer of material and a blank of second layer of material into a desired shape. As illustrated in FIG. 6A, the first layer of material 120 (or the inner layer 120) includes a first portion 160 having a pair of bra cup portions, a second portion 166 connected to the first portion 160 by a pair of strap portions 168, 170, and an elongated opening 172 disposed between the first portion 160 and the second portion 166. The pair of strap portions 168, 170 may extend along a length of the elongated opening 1472 and are disposed spaced apart from each other. Also, the second layer of material 122 (or the outer layer 122) includes a first portion 174 having a pair of bra cup portions 176, 178, a second portion 180 connected to the first portion 174 by a pair of strap portions 182, 184, and an elongated opening 186 disposed between the first portion 174 and the second portion 180. The pair of strap portions 182, 184 may extend along a length of the elongated opening 186 and are disposed spaced apart from each other.

Figure 7A:
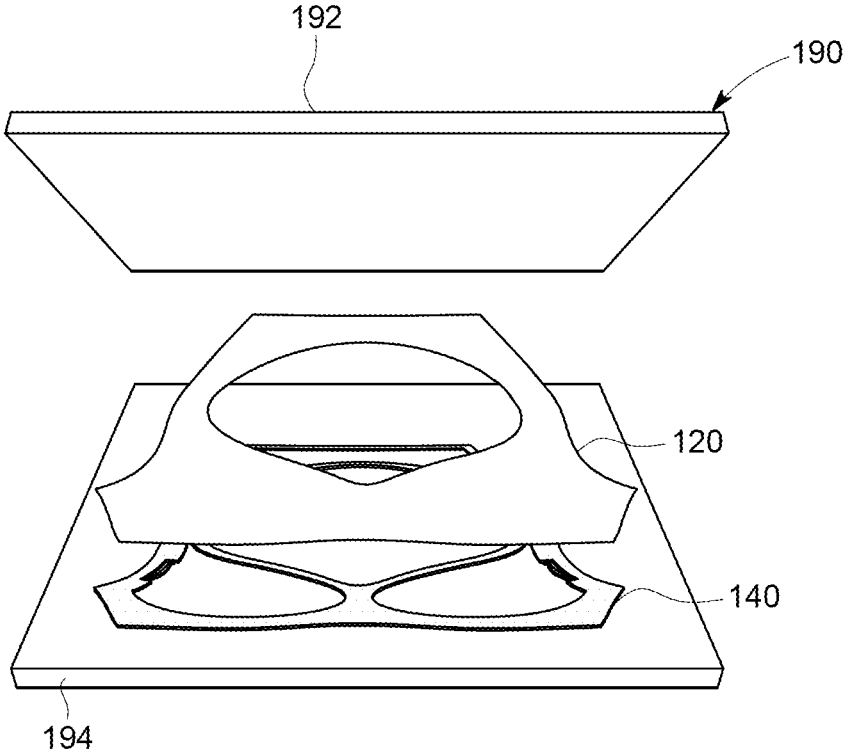
FIG. 7A illustrates a step of the method of manufacturing of the brassiere in which the adhesive is transferred to the inner layer, in accordance with one or more embodiments of the present disclosure.
Figure 7B:
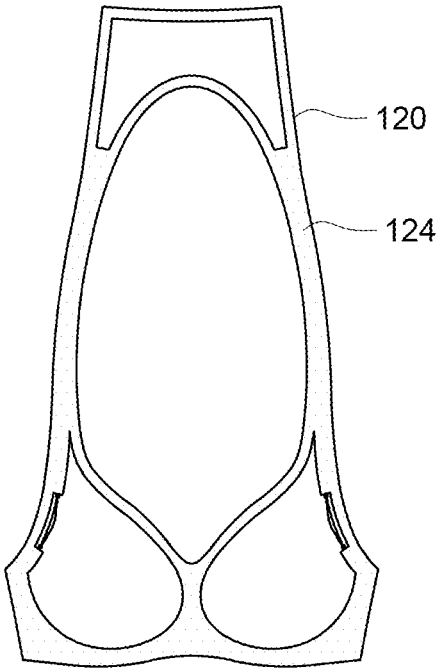
FIG. 7B illustrates a top view of the inner layer having the adhesive, in accordance with one or more embodiments of the present disclosure.

Thereafter, as shown in FIG. 7A, the adhesive is transferred from the release paper 140 with adhesive coating to the first layer of material 120 (i.e. the inner layer 120). For so doing, the release paper 140 and the first layer of material 120 (i.e. the inner layer 120) are positioned inside a mould assembly 190 (herein after referred to as a first mold assembly 190) having an upper mould 192 and a lower mould 194. As illustrated, the release paper 140 with coated adhesive is supported on the lower mould 194 and the first layer of material 120 (the inner layer 120) is positioned overlapping the release paper 140. Thereafter, the upper mould 192 may be pressed against the first layer of material 120 (the inner layer 120) and the release paper 140, and a heating is performed. Due to a pressure and heat, the adhesive gets transferred to the first sheet of material 120 (the inner layer 120). In an embodiment, the adhesive gets deposited on the inner layer 120 as the plurality of dots 124. The inner layer 120 with the plurality of dots deposited on the inner layer 120 is shown in FIG. 7B. Therefore, the adhesive may be transferred to the first layer of material 120 (the inner layer 120) by performing a hot pressing of the release paper 140 and the first layer of material 120 (i.e. inner layer 120).

Figure 8A:
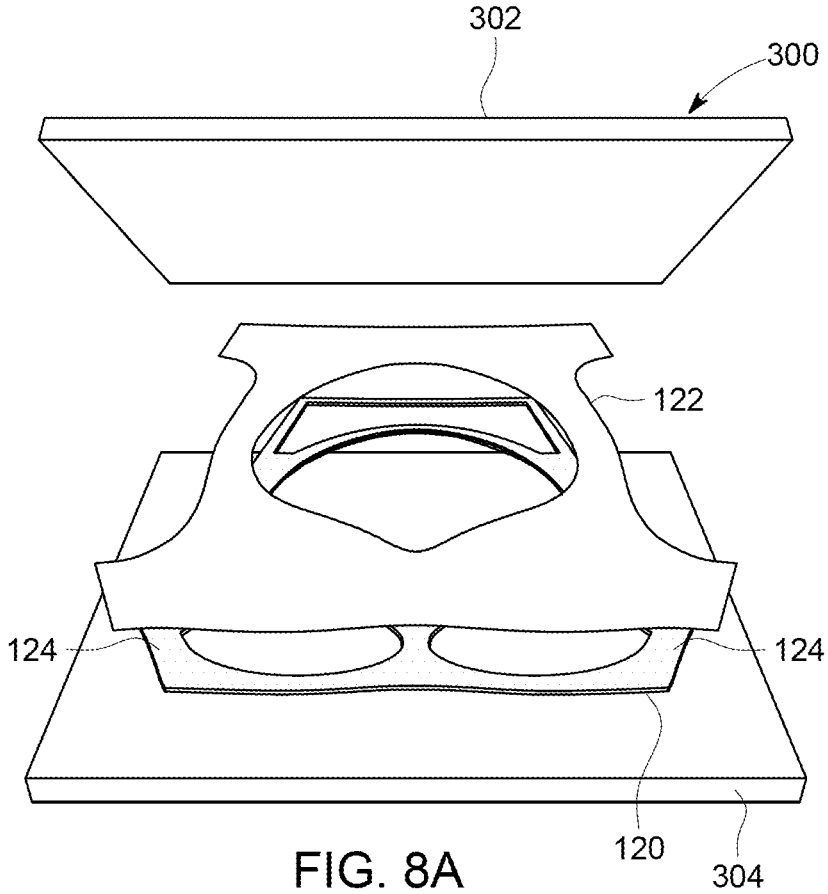
FIG. 8A illustrates a step of the method of manufacturing of the brassiere in which the inner layer and the outer layer is attached with each other, in accordance with one or more embodiments of the present disclosure.
Figure 8B:
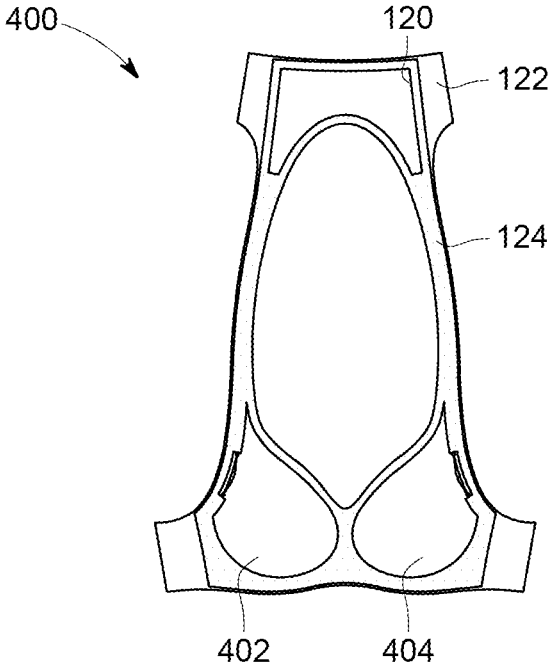
FIG. 8B illustrates a top view of a bra panel formed after the step illustrated FIG. 7A, in accordance with one or more embodiments of the present disclosure.

Subsequently, as shown in FIG. 8A, the first layer of material 120 (i.e. the inner layer 120) is adhesively attached to the second layer of material 122 (i.e. the outer layer 122) by hot pressing the first layer of material 120 and the second layer of material 122. For so doing, the first layer of material 120 having the adhesive and the second layer material 122 is positioned inside a mould assembly 300 (herein after referred to as a second mould assembly 300) having a lower mould 304 and an upper mould 302. In an implementation, the first layer of material 120 and the second layer of material 122 may be disposed in an overlapping configuration such that the first layer of material 120 may rest on the lower mould 304, and adhesive is disposed between the first layer of material 120 and the second layer of material 122. For facilitating an attachment of the first layer of material 120 with the second layer of material 122, the upper mould 302 is pressed against the second layer of material 122, and a heating is performed to facilitate an adhesive bonding between the first layer of material 120 and the second layer of material 122. In this manner a panel of the article of clothing 100, such as a bra panel 400, is formed. The bra panel 400 is shown in FIG. 8B. Subsequent to the hot pressing, a curing of the bra panel 400 is performed to enhance a strength of adhesive bond between the first layer of material 120 and the second layer of material 122.

Figure 9A:
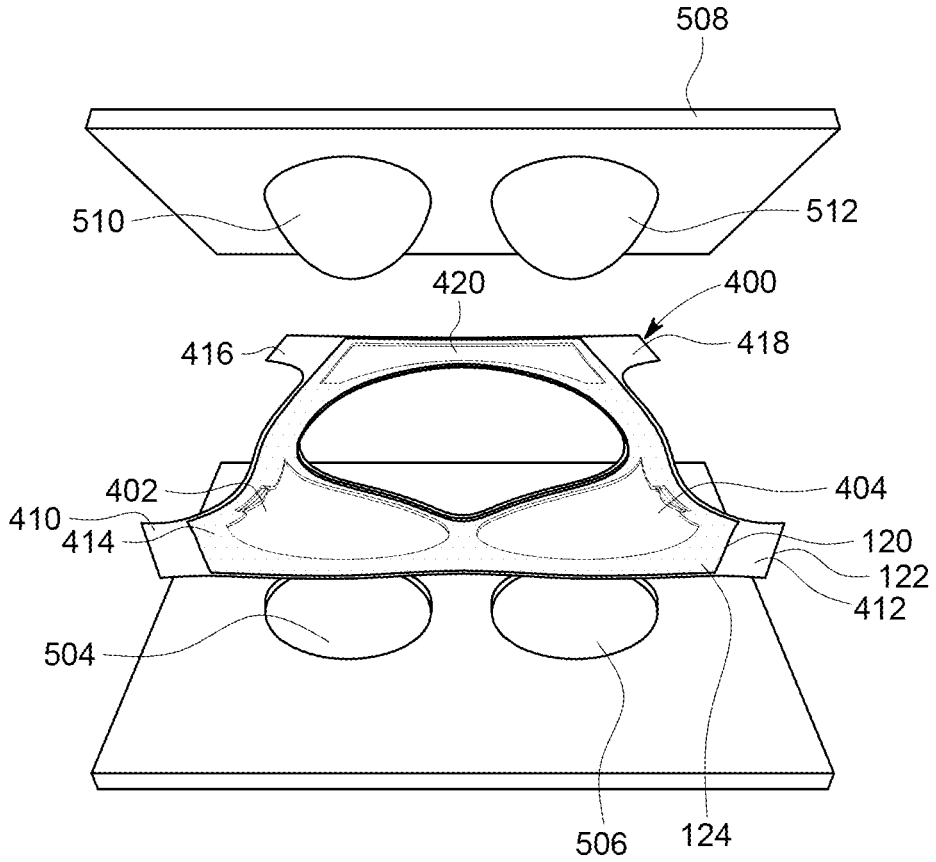
FIG. 9A illustrates a step of the method of manufacturing of the brassiere in which a pair of bra cups of the brassiere are formed, in accordance with one or more embodiments of the present disclosure.
Figure 9B:
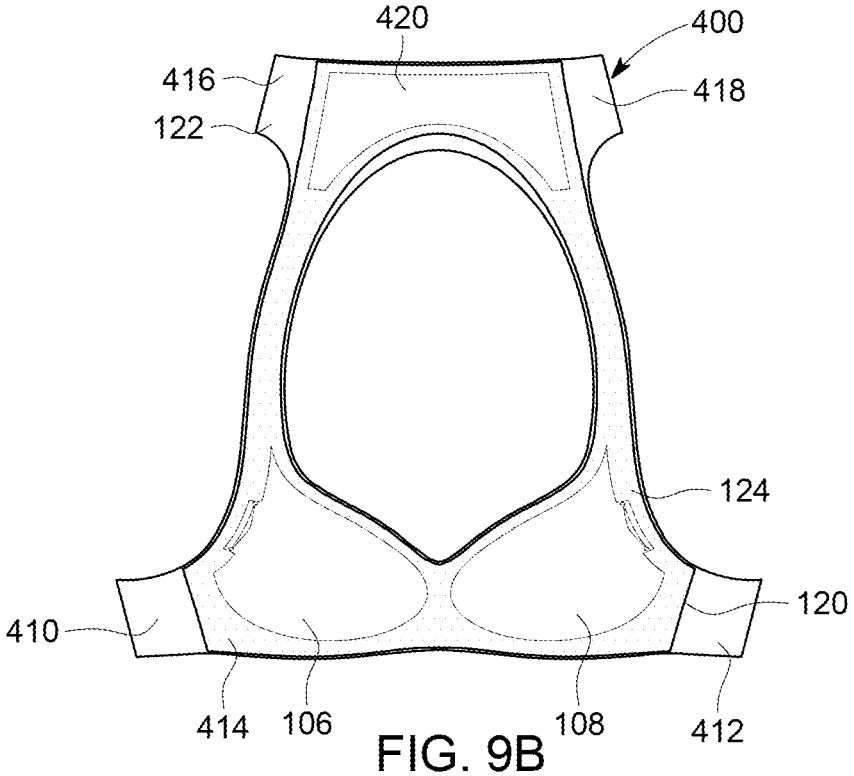
FIG. 9B illustrates a top view of a bra panel having the pair of bra cups, in accordance with one or more embodiments of the present disclosure.
Figure 10B:
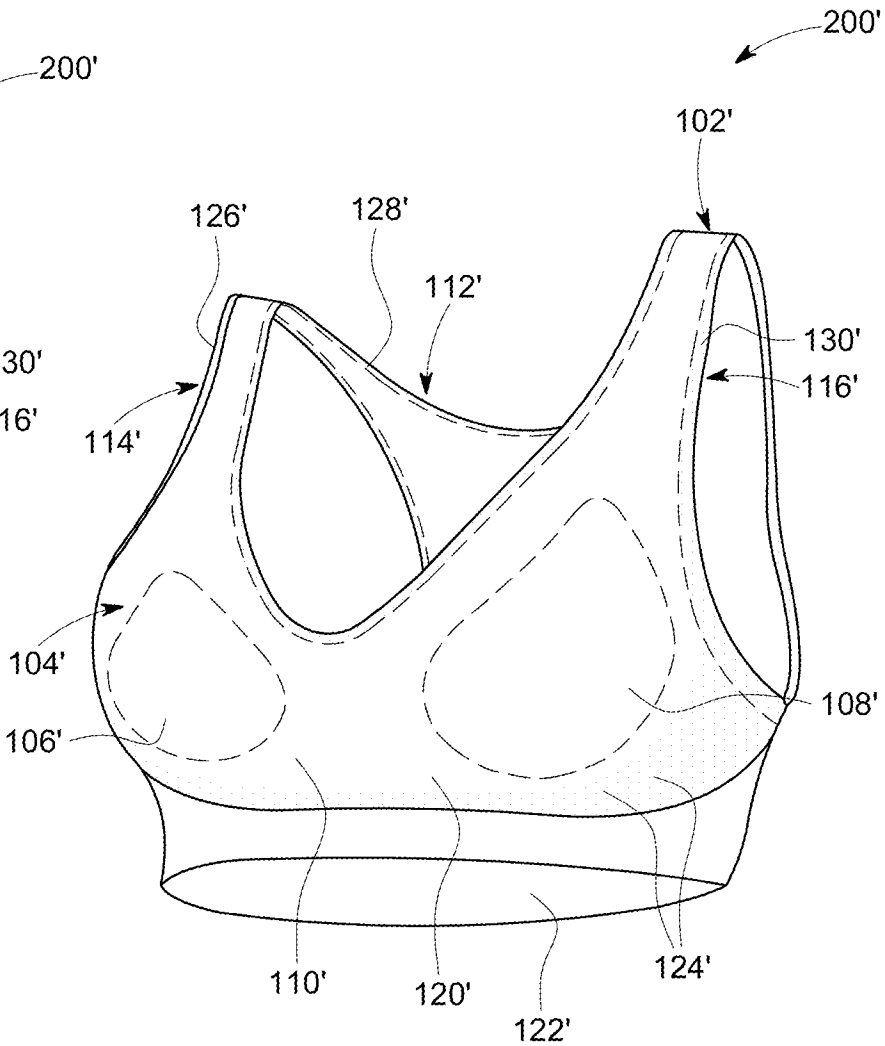
FIG. 10B illustrates a front perspective view of the brassiere of the FIG. 10A that is folded inside out, in accordance with one or more embodiments of the present disclosure.
Figure 10A:
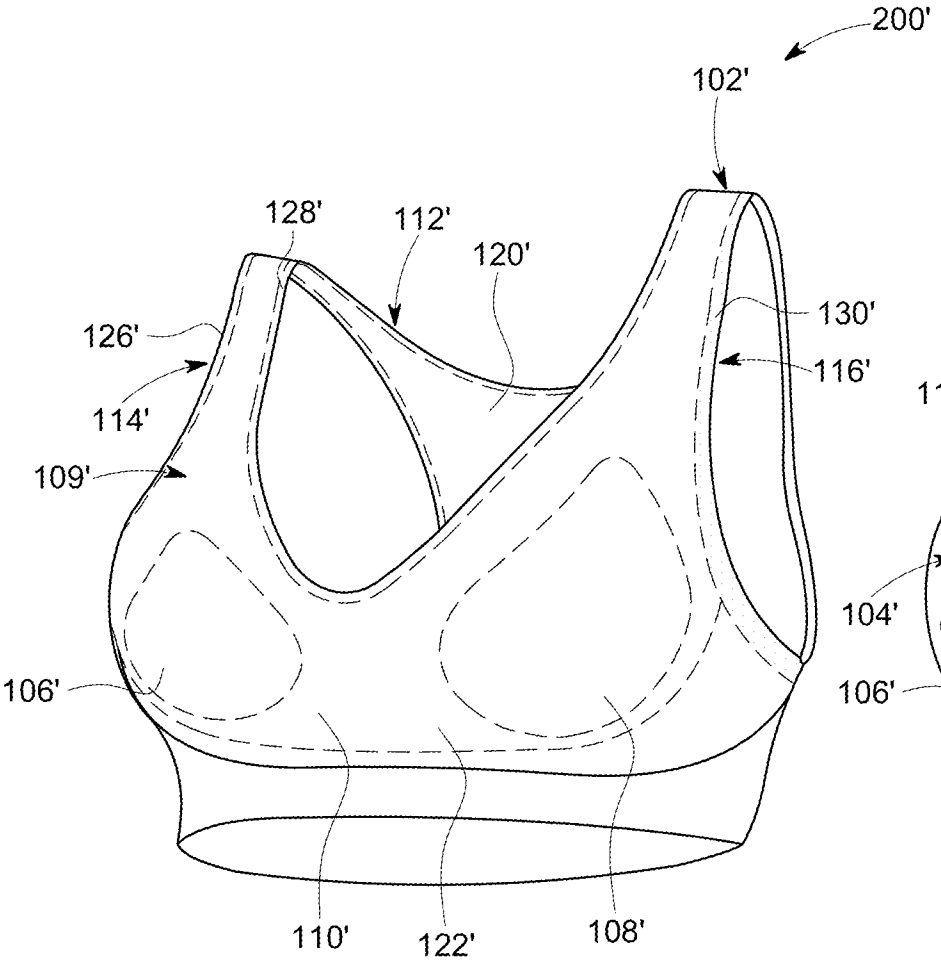
FIG. 10A illustrates a front perspective view of a brassiere, in accordance with one or more embodiments of the present disclosure.
Figure 11B:
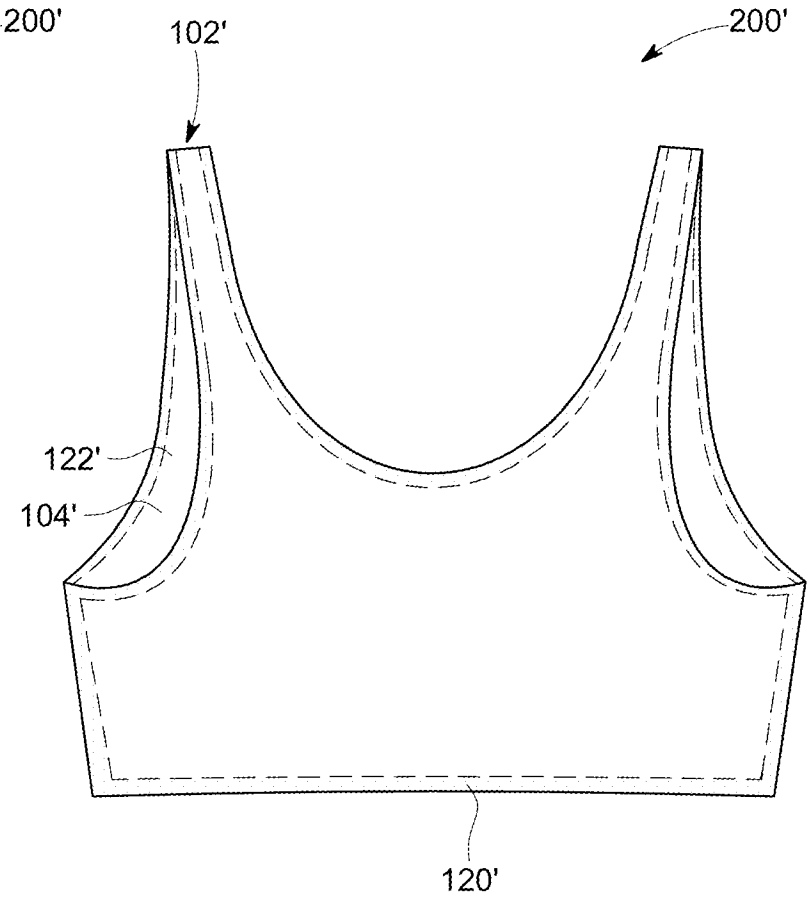
FIG. 11B illustrates a front view of a back portion of the brassiere of FIG. 10B, in accordance with one or more embodiments of the present disclosure.
Figure 11A:
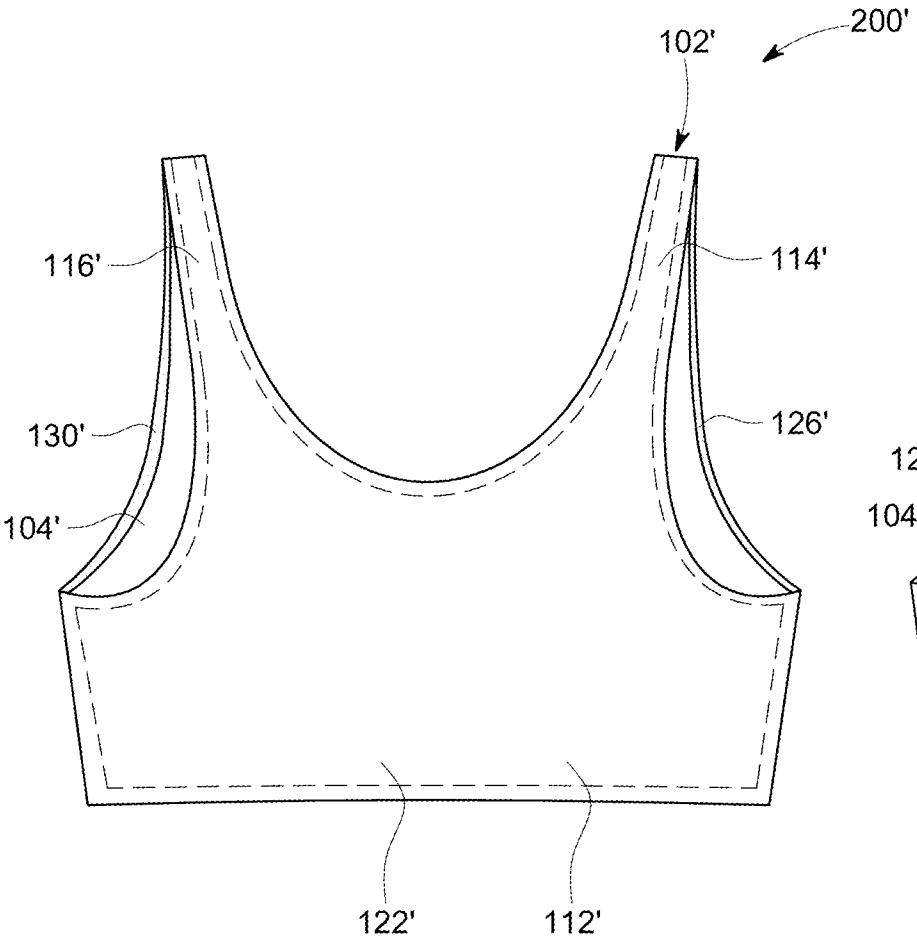
FIG. 11A illustrates a front view of a back portion of the brassiere of FIG. 10A, in accordance with one or more embodiments of the present disclosure.
Figure 12B:
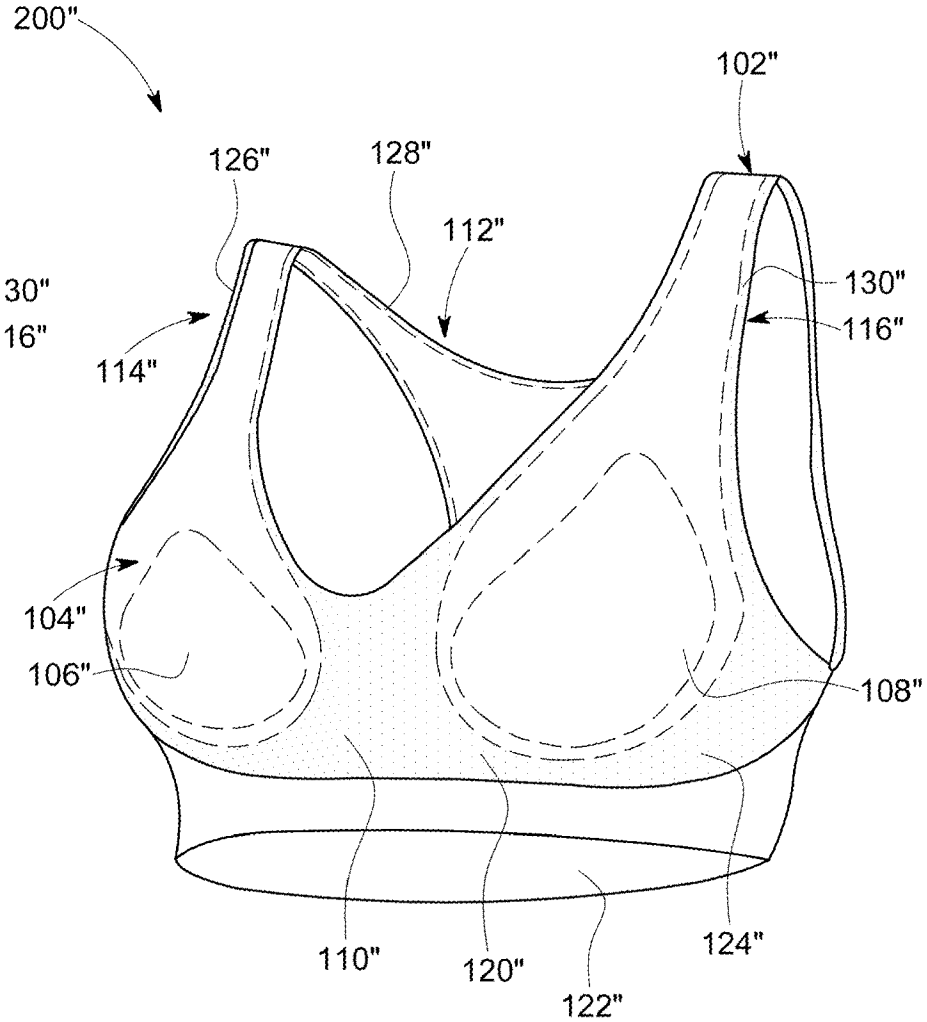
FIG. 12B illustrates a front perspective view of the brassiere of the FIG. 12A that is folded inside out, in accordance with one or more embodiments of the present disclosure.
Figure 12A:
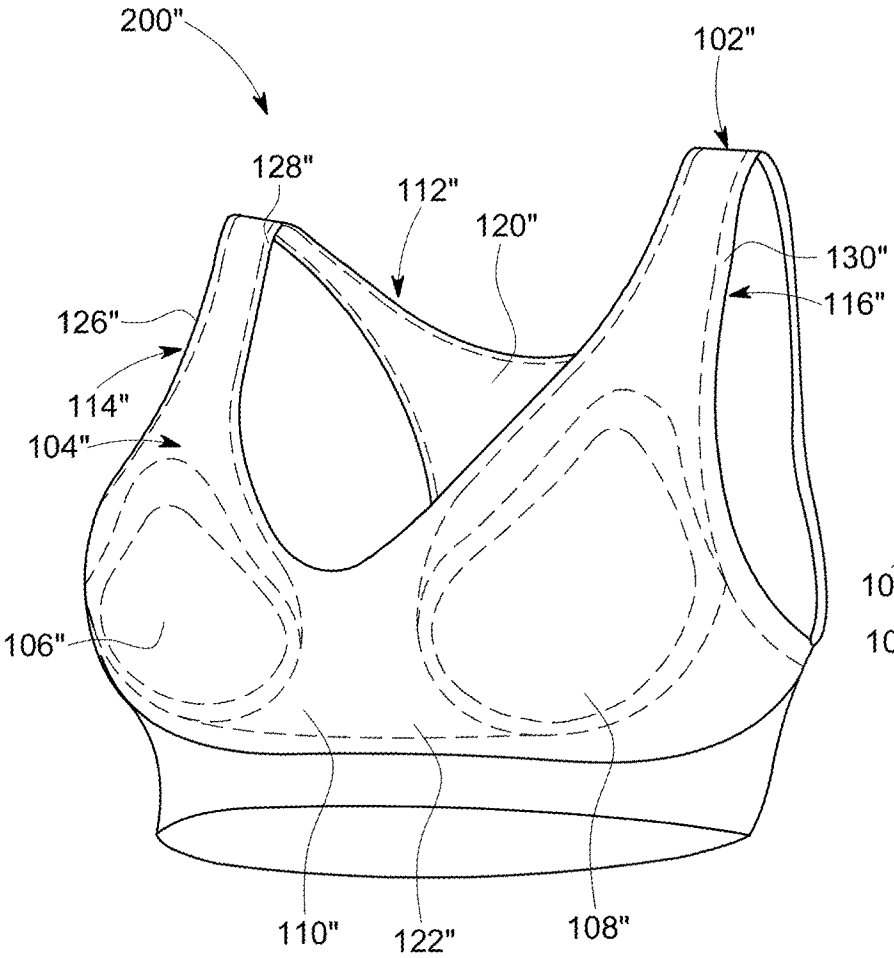
FIG. 12A illustrates a front perspective view of a brassiere, in accordance with one or more embodiments of the present disclosure.
Figure 13B:
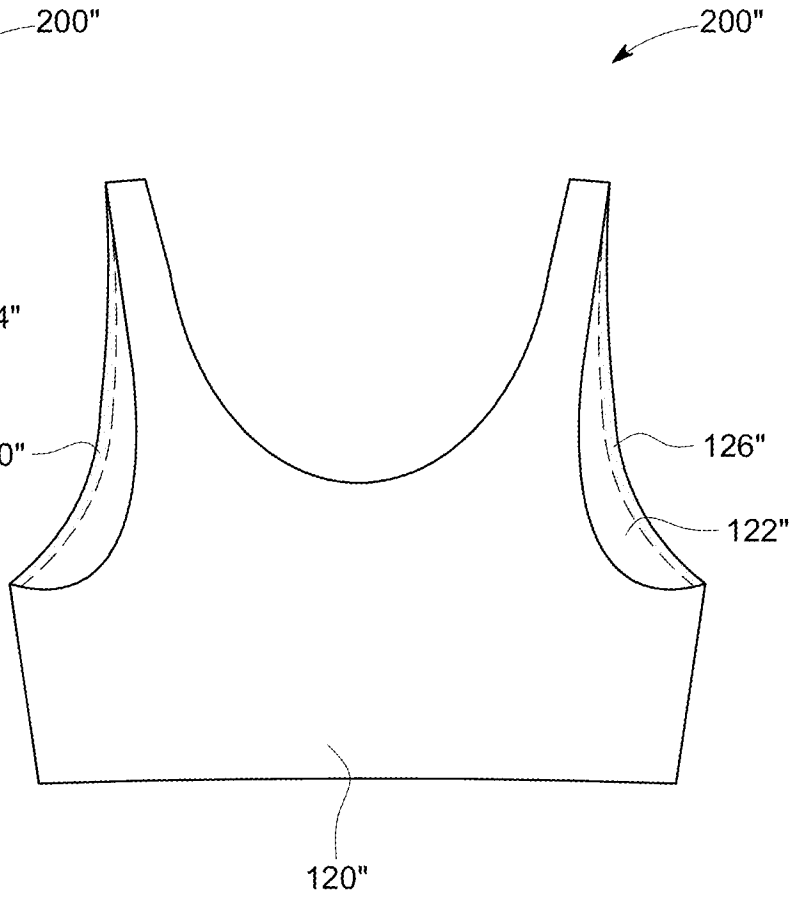
FIG. 13B illustrates a front view of a back portion of the brassiere of FIG. 12B, in accordance with one or more embodiments of the present disclosure.
Figure 13A:
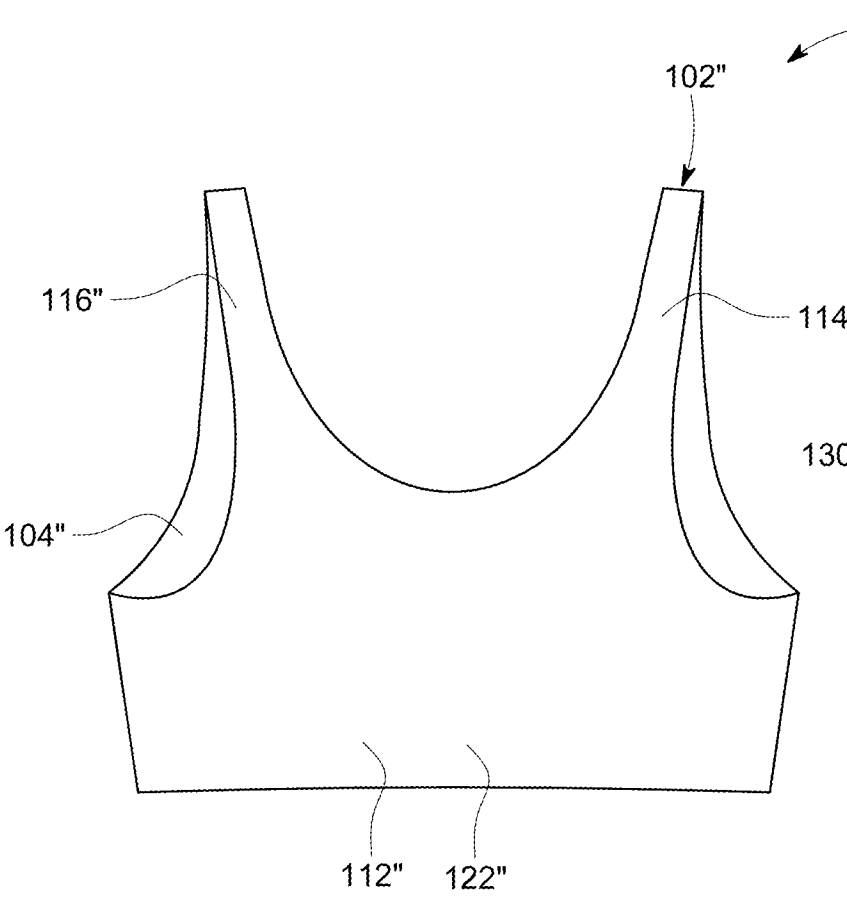
FIG. 13A illustrates a front view of a back portion of the brassiere of FIG. 12A, in accordance with one or more embodiments of the present disclosure.

As shown in FIGS. 1A, 1B, 2A, and 2B, the brassier 200 includes the pair of bra cups 106, 108, and the method may include a moulding process (shown in FIG. 9A) for forming the pair of bra cups 106, 108 when the article of clothing 100 is the brassiere 200. For so doing, a pair of bra cup portions 402, 404 of the bra panel 400 is positioned on a lower mould 502 of a mould assembly 500 (hereinafter referred to as a third mould assembly 500) such that a first bra cup portion 402 covers a first bra cup opening 504 of the lower mould 502 and the second bra cup portion 404 covers a second bra opening 506 of the lower mould 502. Further, an upper mould 508 of the third mould assembly 500 is pressed against the bra panel 400 such that a pair of protrusions 510, 512 of the upper mould 508 press the pair of bra cup portions 402, 404 into the pair of bra cup openings 504, 506, and mould the pair of bra cup portions 402, 404 into the pair of bra cups 106, 108 (as shown in FIG. 9B). In this manner, the pair of bra cups 106, 108 may be formed by hot pressing the bra cup portions 404, 406. Subsequently, lateral edge portions 410, 412 of a front portion 414 of the bra panel 400 is attached to edge portions 416, 418 of a back portion 410 of the bra panel 400 to form the first overlapped portion 132 (shown in FIG. 2B) and the second overlapped portion 134 (shown in FIG. 2B) of the brassier 200. In an embodiment, the lateral edge portions 410, 412 are adhesively attached to the edge portions 416, 418 of the back portion 420 of the bra panel 400. In this manner, the brassier 200 is formed.

Referring to FIGS. 10A, 10B, 11A, and 11B., a brassier 200' is shown according to another embodiment of the disclosure, the brassier 200' is similar in structure and construction to the brassier 200 except that the adhesive is disposed only along edge portions 126', 128', 130' of the inner layer 120' and thus adhesively attached, by adhesive dots 124', to the outer layer 122' along the edge portions 126', 128', 130'. Further, a center gore 110 of the brassiere 200' is devoid of and adhesive between the inner layer 120' and the outer layer 122'. Further, the brassiere 200' includes a body structure 102' having a front portion 104', a back portion 112', a pair of bra cups 106', 108', a pair of straps 114', 116'.

Referring to FIGS. 12A, 12B, 13A, and 13B., a brassier 200" is shown, according to yet another embodiment of the disclosure. The brassier 200" is similar in structure and construction to the brassier 200 except that a back portion 112" of the brassier 200" includes only the outer layer 122" and is devoid of the inner layer 120". Therefore, only a front portion 104" and the straps 114", 116" of the brassier 200" are 2 layered structure, while the back portion 112" of the brassier 200" is a single layered structure. Further, the brassiere 200" may include a body structure 102", a pair of bra cups 106", 108", a center gore 110", the edge portions 126", 128", 130".

Figure 14:
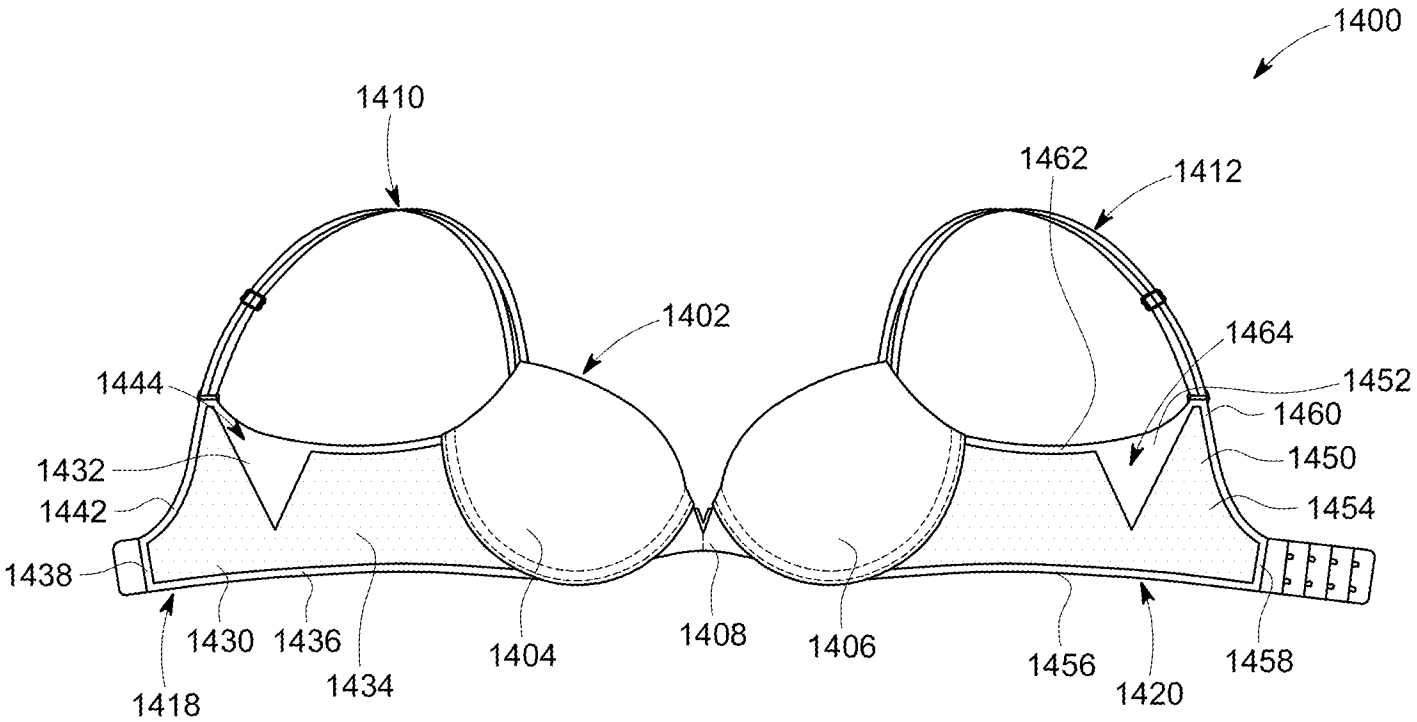
FIG. 14 illustrates a front view of a brassiere, in accordance with one or more embodiments of the present disclosure.

Referring to FIG. 14. a brassier 1400 is shown, according to an alternative embodiment of the disclosure. The brassiere 1400 may includes a body structure 1402 which defines shape of the brassiere 1400. The body structure 1402 includes a pair of bra cups, with a first bra cup 1404 and a second bra cup 1406, and a center gore 1408 disposed between the first bra cup 1404 and the second bra cup 1406 and connecting the first bra cup 1404 and the second bra cup 1406. The brassier 1400 further includes a pair of straps, including a first strap 1410 and a second strap 1412, extending from peripheries of the first bra cup 1404 and the second bra cup 1406, respectively. Further, a pair of side wings, including a first side wing 1418 and a second side wing 1420, of the brassiere 1400 are attached to the peripheries of the first bra cup 1404 and the second bra cup 1406, respectively. It may be contemplated that the pair of straps 1410, 1412 support the brassiere 1400 on shoulders of the wearer, while the pair of side wings 1418, 1420 support the brassier 1400 around a torso of the wearer. In some examples, the pair of straps 1410, 1412 may not be provided and only the pair of side wings 1418, 1420 may support the brassiere on the wearer.

Figure 15A:
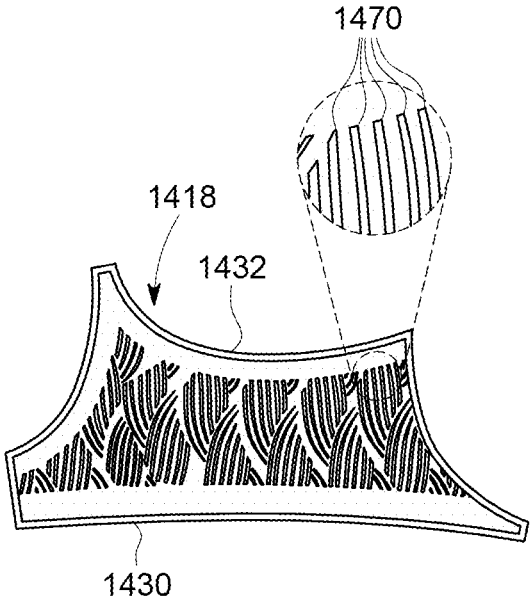
FIG. 15A illustrates a front view of a side wing of the brassiere of FIG. 14 depicting a pattern of adhesive applied on an inner layer of the side wing, in accordance with one or more embodiments of the present disclosure.
Figure 15B:
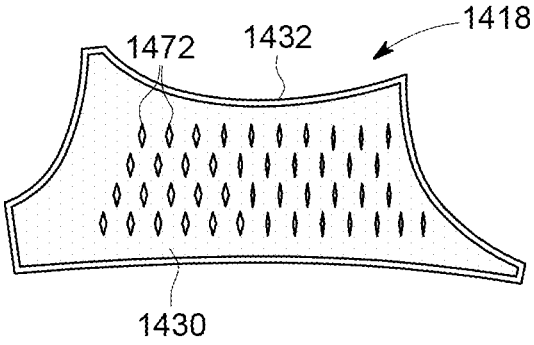
FIG. 15B illustrates a front view of a side wing of the brassiere of FIG. 14 depicting another pattern of adhesive applied on the inner layer of the side wing, in accordance with one or more embodiments of the present disclosure.

In the present embodiments, a first side wing 1418 of the brassier 1400 includes a first layer of material 1430 (also referred to as an inner layer 1430) and a second layer of material 1432 (also referred to as an outer layer 1432) attached to the first layer of material 1430. As shown, the inner layer 1430 is adhesively attached to the outer layer 1432. In an embodiment, the inner layer 1430 is attached to the outer layer 1432 by a plurality of adhesive dots 1434 that are disposed/sandwiched between the inner layer 1430 and the outer layer 1432. In an implementation, as shown in FIG. 14, a size of the outer layer 1432 is larger than the inner layer 1430 such that edge portions 1436, 1438, 1440, 1442 of the brassier 1400 include only the outer layer 1432 and are devoid of the inner layer 1430, and therefore facilitate a smooth transition to a body of the wearer. Further, the first side wing 1418 may also include a triangular cutout portion 1444 defined along the inner layer 1430 and covered by the outer layer 1432 to facilitate a smooth transition to a body of the wearer. In another implementation, a size and a shape of the inner layer match with a shape and a size of the outer layer. Due to double layer structure of the side wing 1418, the side wing 1418 provides better support and firmness near edge of the bra cup 1404, whereas a single layered structure of the side wing 1418 along the edge portions 1436, 1438, 1440, 1442 provides better stretchability and air permeability. In an exemplary embodiment, the adhesive between the inner layer 1430 and the outer layer 1432 may be provided in a predetermined pattern. In an exemplary embodiment, as shown in FIG. 15A, the adhesive may be applied in a pattern that includes a plurality of elongated channels 1470 extending transversely to a direction of first side wing 1418. The elongated channels 1470 defined a region of absence of adhesive. In another exemplary embodiment, as shown in FIG. 15B, the adhesive may be applied in a pattern that includes a plurality of diamond shaped openings 1472 defining a region of absence of adhesive. Also, it may be understood that the any suitable pattern of adhesive dots may be utilized that facilitates a strong bonding between the inner layer 1430 and the outer layer 1432, and also provide desired air permeability and stretchability.

Similar to the first side wing 1418, a second side wing 1420 of the brassiere 1400 include an inner layer 1450, an outer layer 1452, and a plurality of adhesive dots 1454 disposed therebetween to join the inner layer 1450 to the outer layer 1452. The second side wing also include edge portions 1456, 1458, 1460, 1462 that includes only the outer layer 1452 and are devoid of the inner layer 1450, and a substantially triangular cutout 1464 defined along the inner layer 1450.

Figure 16:
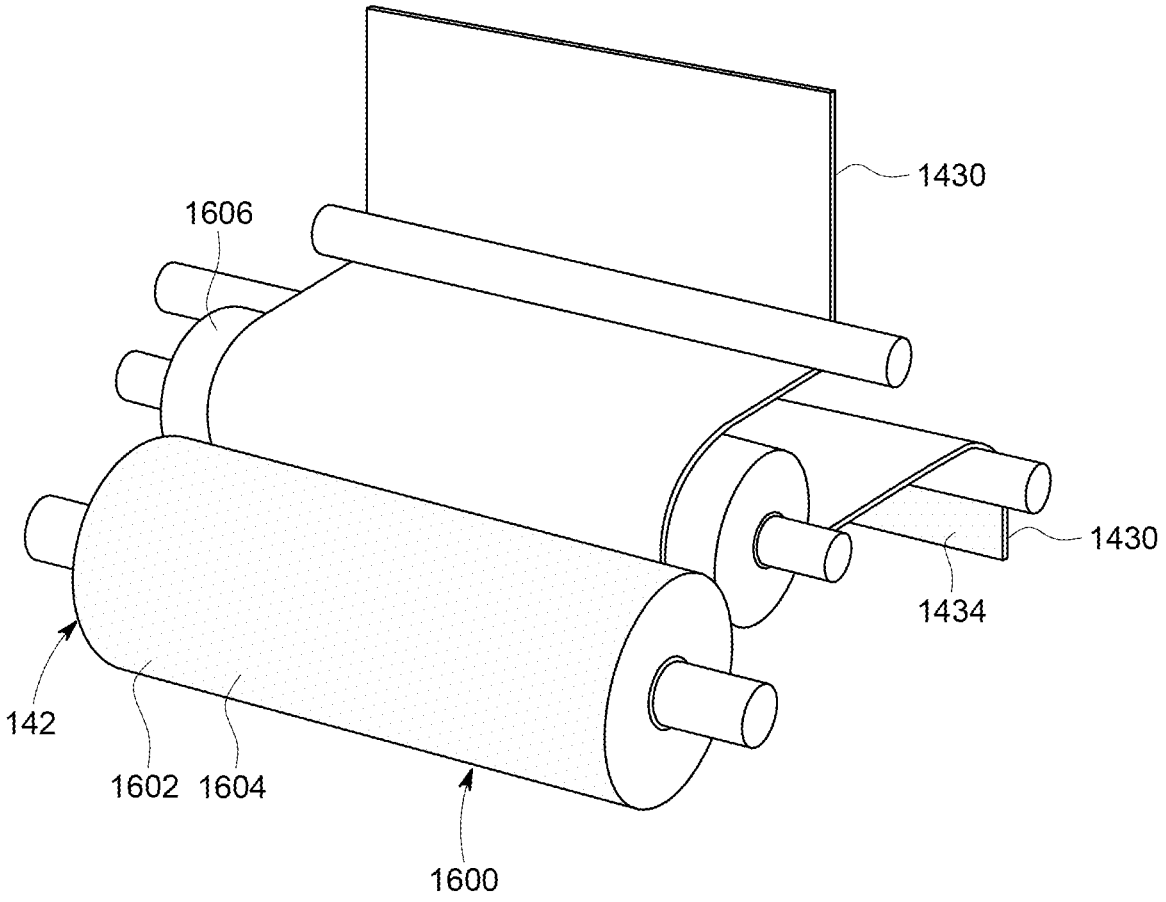
FIG. 16 illustrates a step of the method of manufacturing of a side wing of the brassiere of FIG. 14 in which adhesive is applied on a first layer of material by a roller mechanism, in accordance with one or more embodiments of the present disclosure.

Referring to FIGS. 16 to 19B, various steps of a method of forming the first side wing 1418 of the brassier 1400 according to an alternative embodiment is explained. FIG. 16 discloses a step of method in which an adhesive is applied to the first layer of material 1430 using a roller mechanism 1600. The roller mechanism 1600 may include a first roller 1602 having an adhesive disposed on an outer surface 1604 of the first roller 1602, and a second roller 1606 disposed proximate to the first roller 1602, and adapted to feed the first layer of material 1430 to a space between the first roller 1602 and the second roller 1606. As the first layer of material 1430 passes through the space between the two rollers 1602, 1606, the first layer of material 1430 contacts the outer surface 1604 of the first roller 1602. In so doing, the adhesive is transferred to the first layer of material 1430. In an implementation, the adhesive is applied as a plurality of dots 1434 on the first layer of material 1430. For so doing, the first roller 1602 may include a plurality of grooves (not shown) arranged along the outer surface 1604 of the first roller 1602. The adhesive is then deposited into the grooves, which gets transferred to the first layer of material 1430 as the plurality of dots when the first roller 1602 is heated and pressed against the first layer of material 1430.

Figure 17B:
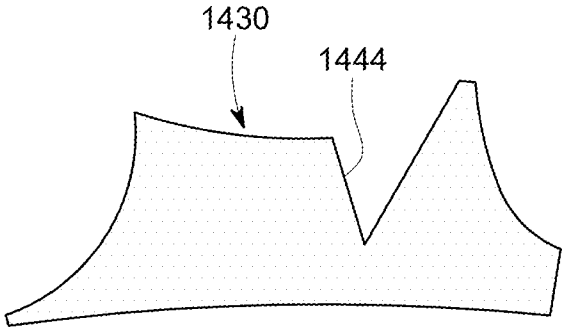
FIG. 17B illustrates a top view of the inner layer of the side wing of the brassier of FIG. 14 having the adhesive, in accordance with one or more embodiments of the present disclosure.
Figure 17A:
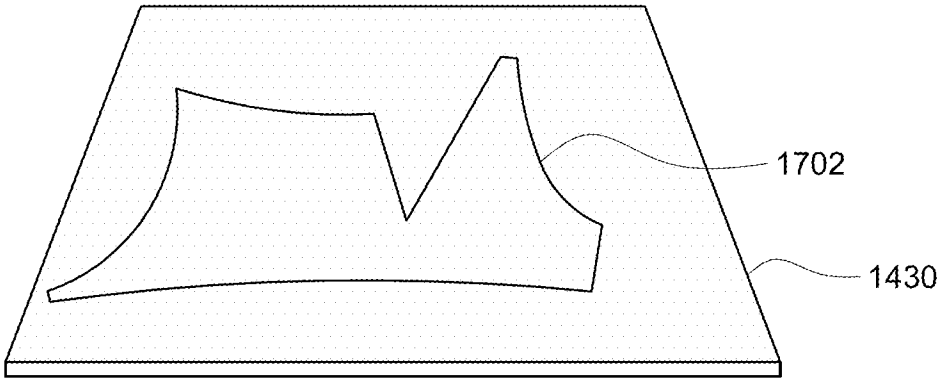
FIG. 17A illustrates a step of the method of manufacturing of the side wing of the brassiere of FIG. 14 in which the first layer of material is cut into a desired shape to form an inner layer of the side wing, in accordance with one or more embodiments of the present disclosure.

Thereafter, as shown in FIG. 17A, the method includes trimming or cutting the first layer of material 1430 coated with adhesive into a desired shape. For so doing, a stencil 1702 may be positioned on the first layer of material 1430 coated with adhesive, and the first layer of material 1430 is cut/trimmed into the desired shape following contours of the stencil 1702. In the example shown in FIG. 17A, the desired shape of first layer of material 1430 corresponds to a shape of the first side wing 1418 of the brassiere 1400, and therefore, the trimmed first layer of material 1430 defines the inner layer 1430 of the first side wing 1418 of the brassiere 1400.

Figure 18A:
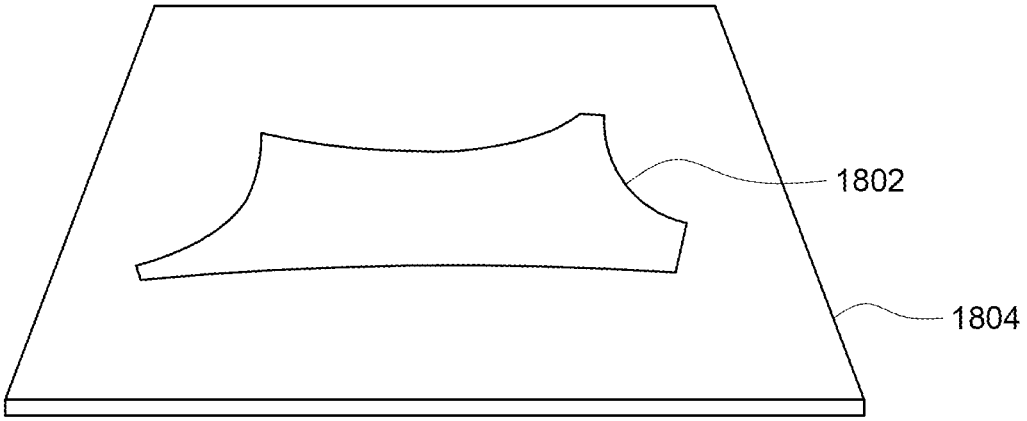
FIG. 18A illustrates a step of the method of manufacturing of the side wing of the brassiere of FIG. 14 in which an outer layer of the side wing is provided, in accordance with one or more embodiments of the present disclosure.
Figure 18B:
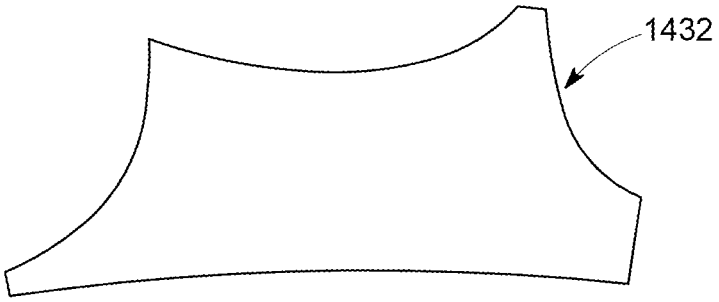
FIG. 18B illustrates a top view of the outer layer of the side wing of the brassiere of FIG. 14, in accordance with one or more embodiments of the present disclosure.

The method also includes, as shown FIG. 18A, providing the second layer of material 1432 (outer layer 1432 of the first side wing 1418 of the brassiere 1400) that includes cutting or trimming a blank of second layer of material 1804 into a desired shape. For so doing, a stencil 1802 may be positioned on the blank of second layer of material 1804, and the blank of second layer of material 1804 is cut/trimmed into the desired shape following contours of the stencil 1802. In the example shown in FIG. 18B, the desired shape of the second layer of material 1432 corresponds to a shape of the first side wing 1418 of the brassiere 1400, and therefore, the trimmed second layer of material 1432 defines the outer layer 1432 of the first side wing 1418 of the brassiere 1400. As illustrated in FIG. 18B, the second layer of material 1432 (or the outer layer 1432) has a shape similar to the inner layer 1430 but includes a larger dimension than that of the inner layer 1430. Further, the outer layer 1432 is devoid of any triangular cut-out similar to the triangular cut-out 1444 of the inner layer 1430.

Figure 19B:
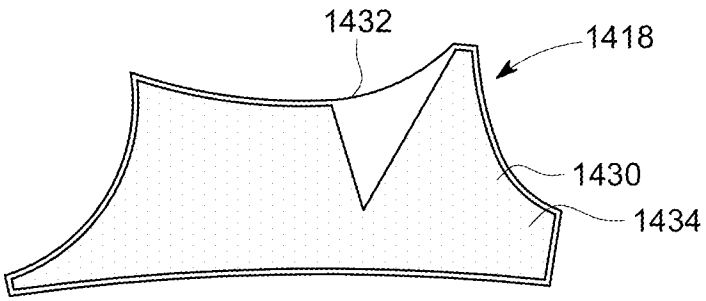
FIG. 19B illustrates a top view of the side wing of the brassiere of FIG. 14 formed after the step illustrated in FIG. 19A, in accordance with one or more embodiments of the present disclosure.
Figure 19A:
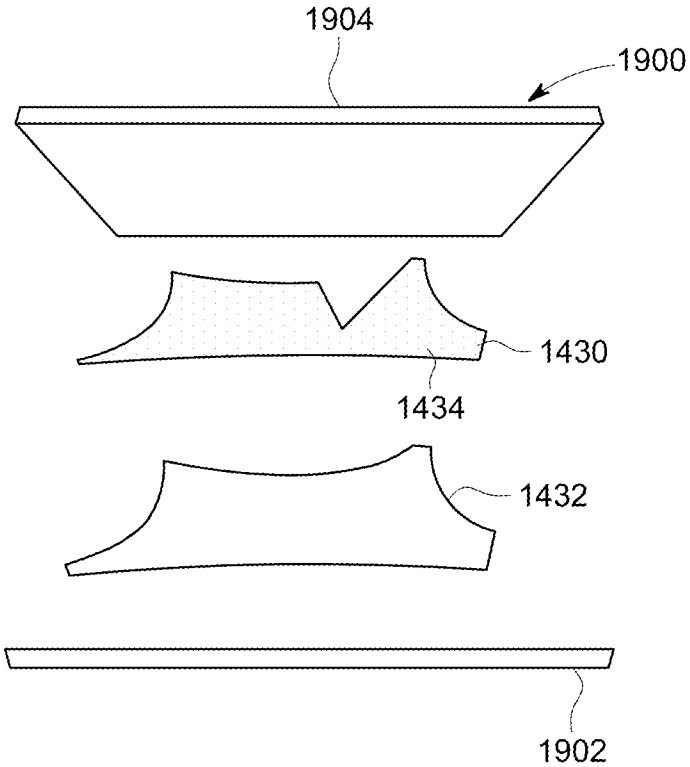
FIG. 19A illustrates a step of the method of manufacturing of the side wing of the brassiere of FIG. 14 in which the inner layer and the outer layer is attached with each other, in accordance with one or more embodiments of the present disclosure.

Subsequently, as shown in FIG. 19A, the inner layer 1430 is adhesively attached to the outer layer 1432 by hot pressing the inner layer 1430 with the outer layer 1432. For so doing, the inner layer 1430 and the outer layer 1432 is positioned inside a mould assembly 1900 (herein after referred to as a fourth mould assembly 1900) having a lower mould 1902 and an upper mould 1904. The inner layer 1430 and the outer layer 1432 are disposed in an overlapping configuration such that the adhesive dots 1434 is disposed therebetween. For attaching the first layer of material 1430 (i.e. the inner layer 1430) with the second layer of material 1432 (i.e. the outer layer 1432), the upper mould 1904 and the lower mould 1902 are pressed against each other, and a heating is enabled to facilitate an adhesive bonding between the inner layer 1430 and the outer layer 1432. In this manner, the first side wing 1418 is manufactured. Subsequent to the hot pressing, a curing of first side wing 1418 is performed to enhance a strength of adhesive bond between the inner layer 1430 and the outer layer 1432. In a similar manner, the second side wing 1420 of the brassiere 1400 is formed. Thereafter, the first side wing 1418 is attached to the first bra cup 1404, while the second side wing 1420 may be attached to the second bra cup 1406. The side wings 1418, 1420 may be attached to the respective bra cups 1404, 1406 in a manner known in the art. Also, the first strap 1410 may be attached to the periphery of the first bra cup 1404 and the first side wing 1418, while the second strap 1412 may be attached to the periphery of the second bra cup 1406 and the second side wing 1420. The straps 1410, 1412 may be coupled/attached to the bra cups 1404, 1406 and the side wings 1418, 1420 in any manner known in the art. In this manner, the brassiere 1400 is formed.

Figure 20:
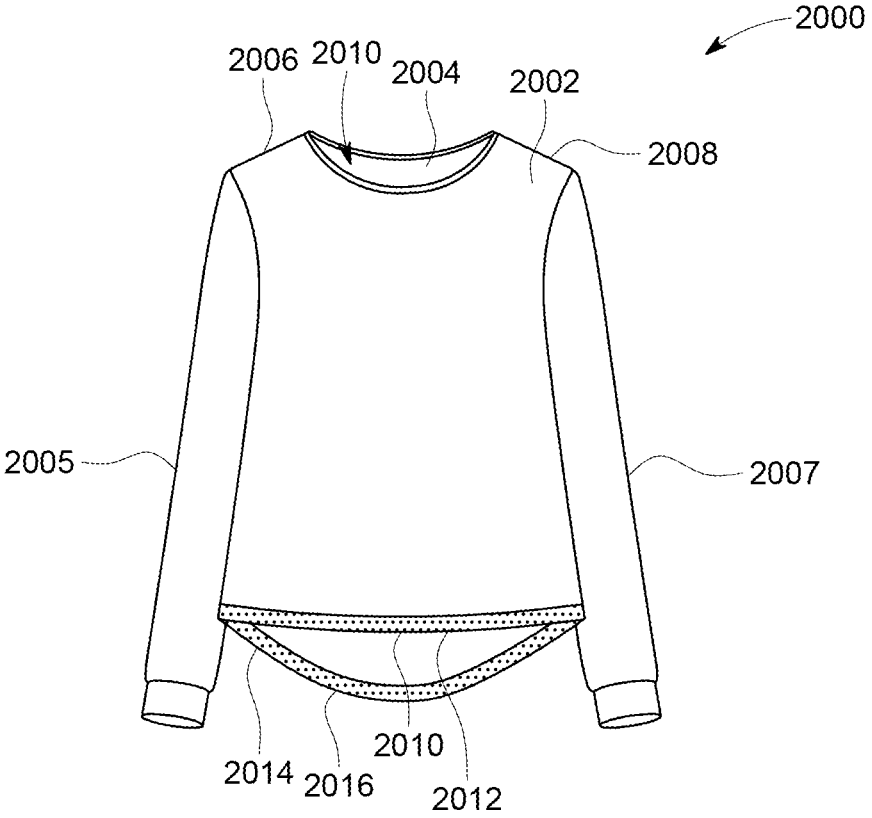
FIG. 20 illustrates a sports shirt as an article of clothing, in accordance with one or more embodiments of the present disclosure.

FIGS. 20-23B illustrate different examples of the article of clothing 100 which may utilize are manufactured by using one or methods of the present disclosure. In FIG. 20, the article of clothing 100 is shown to be a sports shirt 2000. The sports shirt 2000 includes a front portion 2002, a back portion 2004, a first shoulder portion 2006, a second shoulder portion 2008, and a neck opening 2010 defined by the front portion 2002 and the back portion 2004 and disposed between the first shoulder portion 2006 and the second shoulder portion 2008. The sport shirt 2000 may further include a first sleeve 2005 and a second sleeve 2007, each attached to the front portion 2002 and the back portion 2004. The first shoulder portion 2006 and the second shoulder portion 2008 are disposed at a junction of the front portion 2002 and the back portion 2004. Further, the sports shirt 2000 may include a first folded edge portion 2010 disposed along a bottom 2012 of the front portion 2002, and a second folded edge portion 2014 formed along a bottom 2016 of the back portion 2004. The first folded edge portion 2010 may extend in a lateral direction along a width of the front portion 2002, while the second folded edge portion 2014 may extend in a lateral direction along a width of the back portion 2004. The first folded edge portion 2010 is formed by adhesively attaching a first portion of the front portion 2002 to a remaining portion of the front portion 2002 by using the one or more methods explained earlier with reference to the brassiere 200. For forming the first folded edge portion 2010, the adhesive is applied to the first portion of the front portion 2002 by using a release paper as disclosed earlier, and attaching the first portion of the front portion 2002 with the remaining portion of the front portion by hot pressing. Similarly, the second folded edge portion 2014 is formed by adhesively attaching a first portion of the back portion 2004 to a remaining portion of the back portion 2004 by using the one or more methods explained earlier with reference to the brassiere 200. For forming the second folded edge portion 2014, the adhesive may be applied to the first portion of the back portion 2004 by using a release paper as disclosed earlier, and attaching the first portion of the back portion 2004 with the remaining portion of the back portion 2004 by hot pressing.

Figure 21:
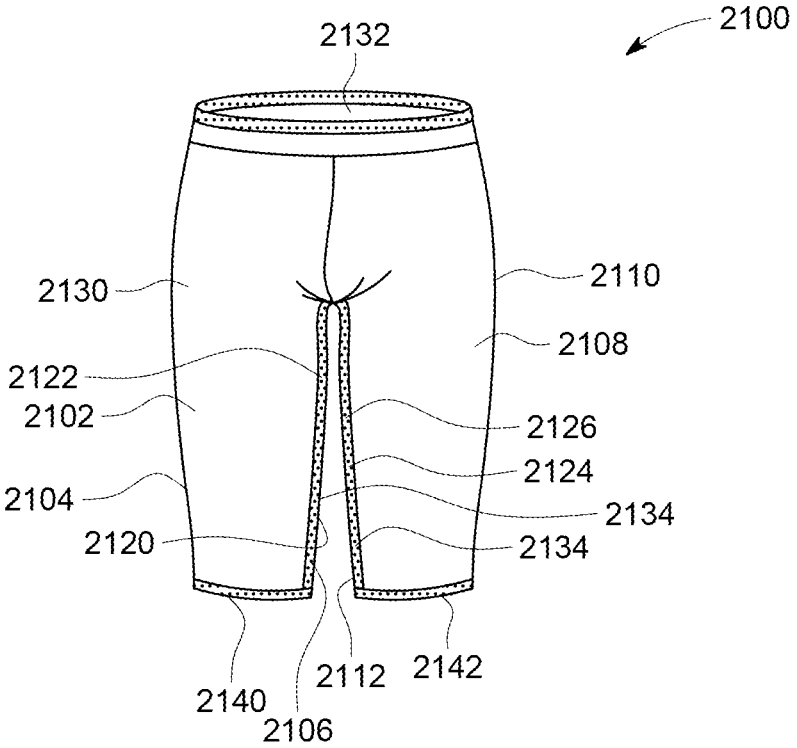
FIG. 21 illustrates a sports pant as an article of clothing, in accordance with one or more embodiments of the present disclosure.

In FIG. 21, the article of clothing 100 is shown to be a sports pant 2100. Referring, the sports pant 2100 includes a first leg portion 2102 having a first outer edge 2014 and a first inner edge 2106 each extending in a longitudinal direction, and a second leg portion 2108 having a second outer edge 2110 and a second inner edge 2112 meeting the first inner edge 2106. Further, the sports pant 2100 includes a first overlapped portion 2120 defining a first seam 2122 of the sports pant 2100, and a second overlapped portion 2124 defining a second seam 2126 of the sports pant 2100. First overlapped portion 2120 extends along the first inner edge 2106 of the first leg portion 2102, while the second overlapped portion 2124 extends along the second inner edge 2112 of the second leg portion 2108. Each of the overlapped portions 2120, 2124 includes a portion of a front panel 2130 of the sports pant 2100 overlapping a back panel 2132 of the sports pant 2100, and includes an adhesive layer 2134 (the first adhesive layer 2134) sandwiched between the front panel 2130 and the back panel 2132. The adhesive layer 2134 joins the front panel 2130 to the back panel 2132. Further, the adhesive layer 2134 is formed by a plurality of dots. The adhesive dots may be applied to the front panel 2130 or the back panel 2132 using a release paper and as explained earlier with reference to the method of manufacturing the article 100 as brassiere 200. Further, the first leg portion 2102 may include a first folded edge portion 2140 along a bottom of the first leg portion 2102, while the second leg portion 2108 may a second folded edge portion 2142 along a bottom of the second leg portion 2108. The folded edge portions 2140, 2142 are formed by adhesively attaching folded portions of the front panel 2130 and the back panel 2132 to respective remaining portions of the front and back panels 2130, 2132. In an embodiment, the adhesive may be applied on the panels 2130, 2132 by using a release paper as described earlier.

Figures 22A, 22B:
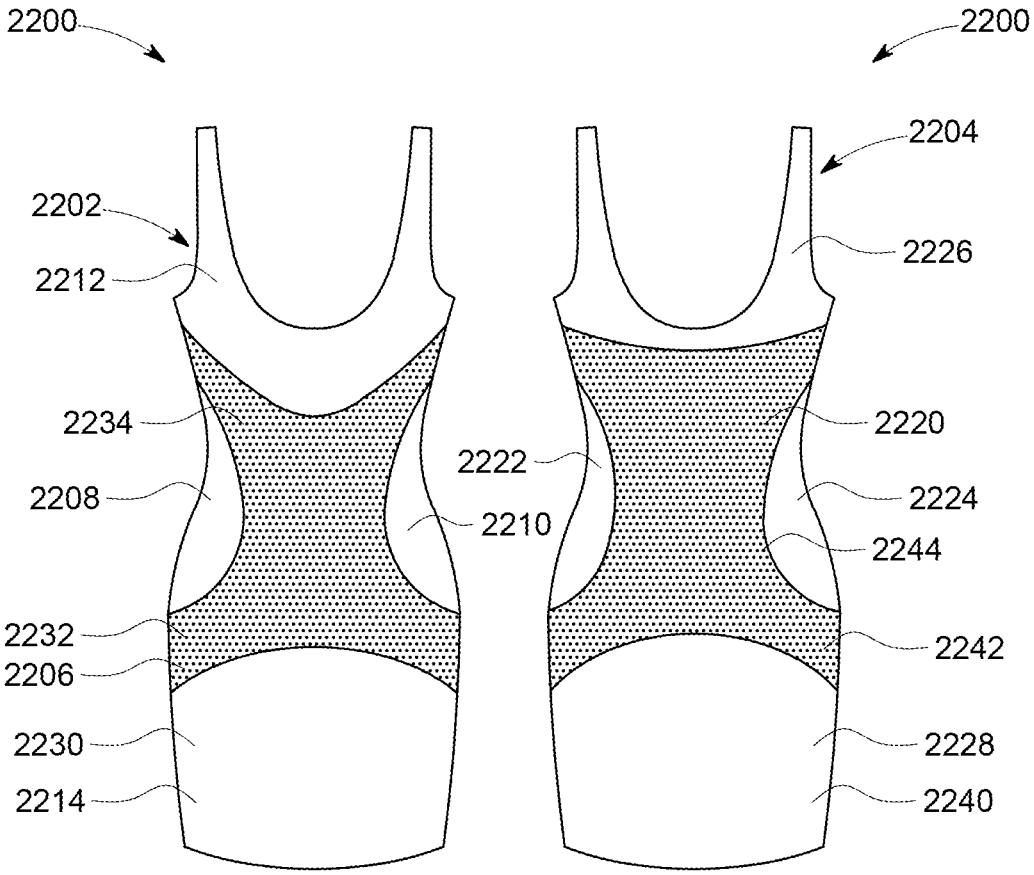
FIG. 22A illustrates a front panel of a shapewear, in accordance with one or more embodiments of the present disclosure.
FIG. 22B illustrates a back panel of the shapewear, in accordance with one or more embodiments of the present disclosure.

Referring to FIGS. 22A and 22B, the article of clothing 100 is shown to be a shapewear 2200 that includes a front panel 2202 (shown in FIG. 22A) and a back panel 2204 (shown in FIG. 22B). The front panel 2202 may include a front central portion 2206, a first front side portion 2208, a second front side portion 2210, a front top portion 2212, and a front bottom portion 2214. The front central portion 2206 may be disposed between the front top portion 2212 and the front bottom portion 2214 in a longitudinal direction, and may be disposed between the first front side portion 2208 and the second front side portion 2210 in a lateral direction. Similarly, the back panel 2204 may include a back central portion 2220, a first back side portion 2222, a second back side portion 2224, a back top portion 2226, and a back bottom portion 2228. The back central portion 2220 may be disposed between the back top portion 2226 and the back bottom portion 2228 in a longitudinal direction, and may be disposed between the first back side portion 2222 and the second back side portion 2224 in a lateral direction.

The front panel 2202 may include an outer layer 2230 and an inner layer 2232 adhesively attached to the outer layer 2230. As shown, a size and shape of the inner layer 2232 may be different from the outer layer 2230. In the illustrated embodiment, a size and a shape of the inner layer 2232 is complimentary to the front central portion 2206, and the inner layer 2232 is attached to area of the outer layer 2230 that corresponds to the front central portion 2206 such that adhesive in the form of adhesive dots 2234 may be disposed therebetween. Therefore, the front central portion 2206 of the front panel 2202 is a two layered structure, while the front top portion 2212, the front bottom portion 2214, and the front side portions 2208, 2210 are single layered structure. In an embodiment, adhesive may be applied to the inner layer 2232 by using a release paper or directly feeding the inner layer 2232 to a roller mechanism as explained earlier. Further, the inner layer 2232 and the outer layer 2230 may be attached by a hot pressing method.

Also, the back panel 2204 may include an outer layer 2240 and an inner layer 2242 adhesively attached to the outer layer 2240. As shown, a size and shape of the inner layer 2242 may be different from the outer layer 2240. In the illustrated embodiment, a size and a shape of the inner layer 2242 is complimentary to the back central portion 2220, and the inner layer 2242 is attached to an area of the outer layer 2240 that corresponds to the back central portion 2220 such that adhesive in the form of adhesive dots 2244 may be disposed therebetween. Therefore, the back central portion 2220 of the back panel 2204 is a two layered structure, while the back top portion 2226, the back bottom portion 2228, and the back side portions 2222, 2224 are single layered structure. In an embodiment, adhesive may be applied to the inner layer 2242 using a release paper or directly feeding the inner layer to a roller mechanism as explained earlier. Further, the inner layer 2242 and the outer layer 2240 are attached by a hot pressing method.

Figure 23A:
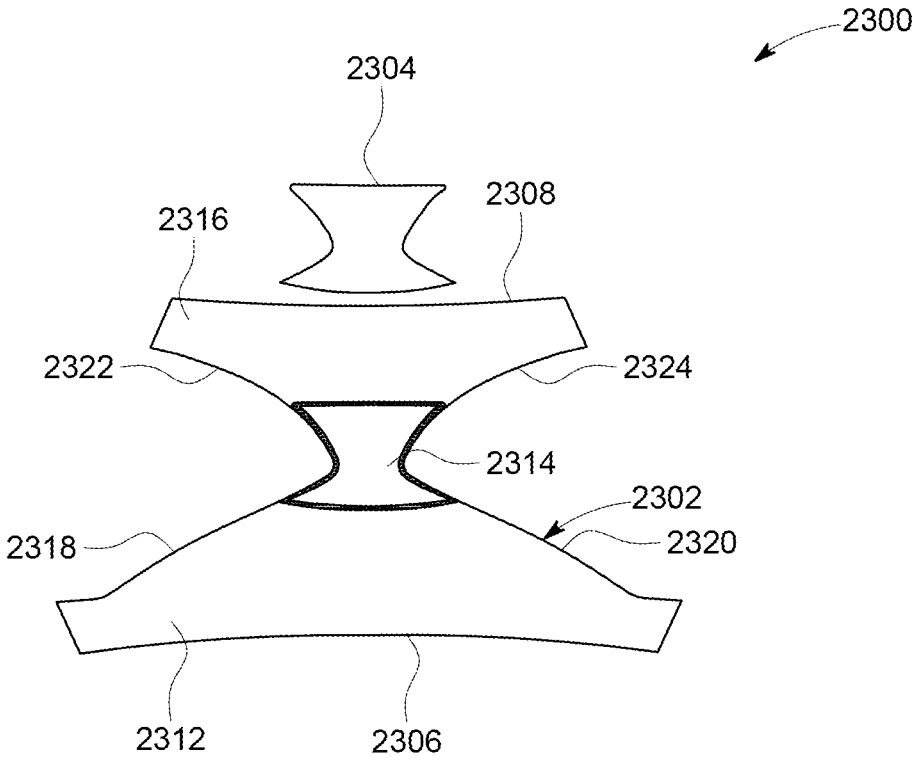
FIG. 23A illustrates a first panel and a second panel of the pantie, in accordance with one or more embodiments of the present disclosure.
Figure 23B:
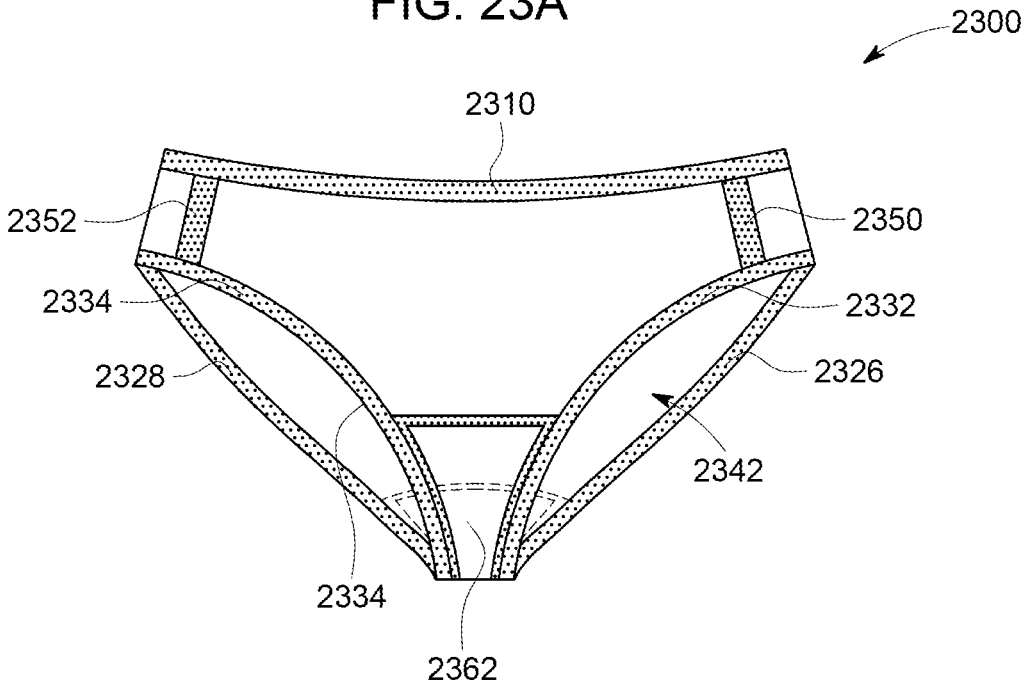
FIG. 23B illustrates a pantie as an article of clothing, in accordance with one or more embodiments of the present disclosure.

In FIGS. 23A and 23B, the article of clothing 100 is shown to be a pantie 2300. The pantie 2300 is manufactured by adhesively attaching a first panel 2302 to a second panel 2304, wherein an adhesive is applied as plurality of dots on the second panel 2304 by using a release paper. Also, the pantie 2300 includes one or more folded portion, each formed by folding a portion of the first panel 2302 and adhesively attaching the portion to a remaining portion of the first panel 2302. For example, the first panel 2302 may include a first lateral edge 2306 and a second lateral edge 2308 disposed substantially opposite to the first lateral edge 2306. A portion of the first panel 2302 extending along the first lateral edge 2306 is folded and adhesively attached to a remaining portion of the first panel 2302 to define a first folded portion (not shown) of the pantie 2300. Similarly, a portion of the first panel 2302 extending along the second lateral edge 2308 is folded and adhesively attached to a remaining portion of the first panel 2302 to define a second folded portion 2310 of the pantie 2300. In this manner, each of the first folded portion and the second folded portion 2310 includes an adhesive layer as a plurality of adhesive dots Additionally, the first panel 2302 may include a shape that resembles a body structure, and may include a first portion 2312, a central portion 2314, and a second portion 2316. The first portion 2312 may extend longitudinally from the first lateral edge 2310 to the central portion 2314, the central portion 2314 extends from the from the first portion 2312 to the second portion 2316, and the second portion 2316 extends from the central portion 2314 to the second lateral edge 2308. The first portion 2312 may include a first arcuate edge 2318 and a second arcuate edge 2320 disposed substantially opposite to the first arcuate edge 2318, while the second portion 2316 may include a third arcuate edge 2322 and a fourth arcuate edge 2324 disposed substantially opposite to the third arcuate edge 2322. It may be noted that a width of the first portion 2312 may decrease in a longitudinal direction away from the first lateral edge 2306 and towards the central portion 2314, and a width of the second portion 2316 may decrease in a longitudinal direction away from the second lateral edge 2308 and towards the central portion 2316.

Further, a third folded portion 2326 of the pantie 2300 and a fourth folded portion 2328 of the pantie 2300 are formed by respectively folding a portion of the first panel 2302 along the first arcuate edge 2318 and folding a portion of the first panel 2302 along the second arcuate edge 2320, and adhesively attaching the folded portions to the remining portion of the first panel 2302. In this manner, each of the third folded portion 2326 and the fourth folded portion 2328 includes an adhesive layer as a plurality of adhesive dots. Also, Further, a fifth folded portion 2332 of the pantie 2300 and a sixth folded portion 2334 of the pantie 2300 is formed by respectively folding a portion of the second portion 2316 of the first panel 2302 along the third arcuate edge 2322 and folding a portion of the second portion 2316 of the first panel 2302 along the fourth arcuate edge 2324, and adhesively attaching the folded portion to the remining portion of the second portion 2316 of the first panel 2302. In this manner, each of the fifth folded portion 2332 and the sixth folded portion 2334 includes an adhesive layer as a plurality of adhesive dots. The folded portions 2310, 2326, 2328, 2332, 2334 are formed by adhesively attaching folded portions of the front panel 2302 to respective remaining portions of the front panel 2302. In an embodiment, the adhesive may be applied on the panel 2302 by using a release paper as described earlier.

The pantie 2300 includes a waist opening (not shown), a first leg opening 2342, and a second leg opening 2344. The first leg opening 2342 is defined by the third folded portion 2326 and fifth folded portion 2332 such that the third folded portion 2326 is disposed facing the fifth folded portion 2332, while the fourth folded portion 2328 and the sixth folded portion 2334 together define the second leg opening 2344, and are disposed facing each other. It may be appreciated that the first leg opening 2342 and the second leg opening 2344 are formed when the first portion 2312 of the first panel 2302 and the second portion 2316 of the first panel 2302 are adhesively attached to each other such that the first portion 2312 and the second portion 2316 are disposed facing other. Adhesive coupling of the first portion 2312 and the second portion 2316 defines a first overlapped portion 2350 and a second overlapped portion 2352 of the pantie 2300. The first overlapped portion 2350 may extend from the first leg opening 1142 to the waist opening, while the second overlapped portion 2352 may extend from the second leg opening 2344 to the waist opening. Each of the first overlapped portion 2350 and the second overlapped portion 2352 may include am adhesive layer defined by a plurality of adhesive dots sandwiched between the first portion 2312 and the second portion 2316. The adhesive may be applied using a release paper as described earlier.

The pantie 2300 also include the second panel 2304 adhesively bonded or attached to the central portion 2314 of the first panel 2302. The second panel 2304 is attached to the central portion 2314 by applying adhesive dots along edges of the second panel 2304 by using a release paper, and adhesively bonding the edges of the second panel 2304 to the central portion 2314 such that the adhesive dots are disposed between the second panel 2304 and the central portion 2314. In an embodiment, the adhesive may be applied to entire surface of the second panel 2304 by using a release paper or by directly feeding a panel of material into a roller mechanism and then cutting the panel of material into a desired shape to form the second panel 2304. Therefore, the pantie 2300 includes a central overlapped portion 2362 having an adhesive layer disposed between the first panel 2302 and the second panel 2304, wherein the adhesive layer is defined by the adhesive dots and joins the second panel 2304 to the first panel 2302.

The foregoing descriptions of specific embodiments of the present disclosure have been presented for purposes of illustration and description. They are not intended to be exhaustive or to limit the present disclosure to the precise forms disclosed, and obviously many modifications and variations are possible in light of the above teaching. The exemplary embodiment was chosen and described in order to best explain the principles of the present disclosure and its practical application, to thereby enable others skilled in the art to best utilize the present disclosure and various embodiments with various modifications as are suited to the particular use contemplated.

What is claimed is:

1. A method of manufacturing an article of clothing, the method comprising:

applying a plurality of adhesive dots to a release paper and trimming the release paper having the plurality of adhesive dots to a desired shape and size;

providing a first layer of material and a second layer of material;

transferring the plurality of adhesive dots from the release paper to the first layer of material;

adhesively bonding the first layer of material to the second layer of material; and curing the plurality of adhesive dots disposed between the first layer of material and the second layer of material.

2. The method of claim 1, wherein the plurality of adhesive dots are applied on the release paper by feeding the release paper through a roller mechanism having a roller with the plurality of adhesive dots disposed on a surface of the roller.

3. The method of claim 1, wherein providing the first layer of material includes trimming first layer of material into a desired shape and size.

4. The method of claim 1, wherein transferring the plurality of adhesive dots from the release paper to the first layer of material includes:

positioning the first layer of material on the release paper such that the plurality of adhesive dots are sandwiched between the release paper and the first layer of material; and hot pressing the first layer of material and the release paper to facilitate a transfer of the plurality of adhesive dots to the first layer of material.

5. The method of claim 1, wherein adhesively bonding the first layer of material and the second layer of material includes:

positioning the second layer of material on the first layer of material such that the plurality of adhesive dots is are sandwiched between the first layer of material and the second layer of material; and hot pressing the first layer of material and the second layer of material to facilitate the adhesive boding of first layer of material and the second layer of material.

6. The method of claim 1, wherein the first layer of material is an inner layer of the article of clothing and the second layer of material is an outer layer of the article of clothing.

7. A method of manufacturing at least a portion of an article of clothing, the method comprising:

applying a plurality of adhesive dots to a first layer of material and trimming the first layer of material having the plurality of adhesive dots to a desired shape and size;

providing a second layer of material;

adhesively bonding, by hot pressing, the first layer of material to the second layer of material; and curing the plurality of adhesive dots disposed between the first layer of material and the second layer of material.

8. The method of claim 7, wherein the plurality of adhesive dots are applied on the first layer of material by feeding the first layer of material through a roller mechanism having a roller with the plurality of adhesive dots disposed on a surface of the roller.

9. The method of claim 7, wherein providing the second layer of material includes trimming second layer of material into a desired shape and size.

10. The method of claim 7, wherein adhesively bonding the inner layer and the outer includes:

positioning the second layer of material on the first layer of material such that the plurality of adhesive dots is are sandwiched between the second layer of material and the first layer of material; and hot pressing the first layer of material and the second layer of material to facilitate the adhesive bonding of the first layer of material and the second layer of material.

11. The method of claim 7, wherein the first layer of material is an inner layer of the article of clothing and the second layer of material is an outer layer of the article of clothing.

12. A method of manufacturing a brassiere, the method comprising:

applying a plurality of adhesive dots to a release paper and trimming the release paper having the plurality of adhesive dots to a desired shape and size;

providing a first layer of material defining an inner layer of the brassiere and a second layer of material defining an outer layer of the brassiere;

transferring the plurality of adhesive dots from the release paper to inner layer;

adhesively bonding the inner layer to the outer layer to form a bra panel of the brassiere; and curing the plurality of adhesive dots disposed between the inner layer and the outer layer.

13. The method of claim 12, wherein the plurality of adhesive dots are applied on the release paper by feeding the release paper through a roller mechanism having a roller with the plurality of adhesive dots disposed on a surface of the roller.

14. The method of claim 12, wherein providing the first layer of material includes trimming the first layer of material to define the outer layer of brassiere, wherein the outer layer includes a first portion, a second portion, an elongated opening disposed between the first portion and the second portion, and a pair of strap portion connecting the first portion to the second portion.

15. The method of claim 14, wherein a lateral width of the first portion of the outer layer is greater than a lateral width of the first portion of the inner layer.

16. The method of claim 14, wherein a lateral width of the second portion of the outer layer is greater than a lateral width of the second portion of the inner layer.

17. The method of claim 14, wherein the first portions of the inner layer and the outer layer define a front portion of the brassiere, and the second portions of the inner layer and the outer layer defines a back portion of the brassiere.

18. The method of claim 12, wherein transferring the plurality of adhesive dots from the release paper to inner layer includes:

positioning the inner layer on the release paper such that the plurality of adhesive dots are sandwiched between the release paper and the inner layer; and hot pressing the inner layer and the release paper to facilitate a transfer of the plurality of adhesive dots to the inner layer.

19. The method of claim 12, wherein adhesively bonding the inner layer and the outer layer includes:

positioning the outer layer on the inner layer such that the plurality of adhesive dots are sandwiched between the inner layer and the outer layer; and hot pressing the inner layer and the outer layer to facilitate the adhesive boding of the inner layer and the outer layer.

20. The method of claim 12, wherein the bra panel includes a pair of bra cup portions formed by the inner layer disposed abutting the outer layer, the method further including:

positioning the bra panel on a first mould having a pair of bra cup openings, the bra panel being positioned on the first mould such that the pair of cup portions are disposed above the pair of bra cup openings; and hot pressing a second mould on the bra panel to form a pair of bra cups of the brassiere, wherein the second mould includes a pair of protrusions corresponding to the pair of bra cup openings for pushing the pair of cup portions into the pair of openings to form the pair of bra cups.

* * * * *